US008265527B2

(12) United States Patent
Shiraishi et al.

(10) Patent No.: US 8,265,527 B2
(45) Date of Patent: Sep. 11, 2012

(54) DEVELOPING UNIT, IMAGE FORMING APPARATUS INCORPORATING SAME, AND METHOD OF CONTROLLING AMOUNTS OF TONER

(75) Inventors: Emiko Shiraishi, Tokyo (JP); Kentaroh Tomita, Sagamihara (JP); Takehide Mizutani, Sagamihara (JP); Takayuki Tamaki, Sagamihara (JP); Masumi Sato, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 634 days.

(21) Appl. No.: 12/394,617

(22) Filed: Feb. 27, 2009

(65) Prior Publication Data

US 2009/0220266 A1 Sep. 3, 2009

(30) Foreign Application Priority Data

Feb. 28, 2008 (JP) ..... 2008-047350
Mar. 14, 2008 (JP) ..... 2008-066828

(51) Int. Cl.
*G03G 15/08* (2006.01)

(52) U.S. Cl. ..... 399/255; 399/24; 399/59; 399/120

(58) Field of Classification Search ..... 399/25, 399/27, 58, 59, 119, 120, 254–256, 260–264
See application file for complete search history.

(56) References Cited

U.S. PATENT DOCUMENTS

2004/0175207 A1* 9/2004 Shoji et al. ..... 399/274
2006/0204283 A1* 9/2006 Yasuda ..... 399/254
2007/0122202 A1 5/2007 Taguma et al.
2007/0127951 A1 6/2007 Ishikawa et al.
2007/0274741 A1 11/2007 Shiraishi et al.
2008/0145078 A1 6/2008 Tomita et al.
2008/0181670 A1 7/2008 Tsuda et al.
2008/0187332 A1 8/2008 Tsuda et al.

FOREIGN PATENT DOCUMENTS

JP 10-26885 1/1998
JP 2003-76079 3/2003
JP 3568088 6/2004
JP 2007-193289 8/2007

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

A developing unit, which is incorporated in an image forming apparatus, includes a developer case to accommodate a two-component developer including toner and carrier, a developer bearing member bearing the two-component developer to supply the developer to an image, a developer supply path formed inside the developer case to supply the developer along the developer bearing member, an agitation and conveyance member disposed in the developer supply path, a toner collecting mechanism to collect toner after development, and a collected toner conveyance path formed inside the developer case and including a collected toner conveying member. The collected toner conveyance path and the developer supply path are arranged in communication with each other in the vicinity of one end portion of the collected toner conveyance path in a direction of conveyance of collected toner so as to circulate toner unused for development.

20 Claims, 16 Drawing Sheets

DEVELOPING UNIT, IMAGE FORMING APPARATUS INCORPORATING SAME, AND METHOD OF CONTROLLING AMOUNTS OF TONER

CROSS-REFERENCE TO RELATED APPLICATIONS

The present invention claims priority pursuant to 35 U.S.C. §119 from Japanese Patent Application No. 2008-047350, filed on Feb. 28, 2008 in the Japan Patent Office, and Japanese Patent Application No. 2008-066828, filed on Mar. 14, 2008 in the Japan Patent Office, the contents and disclosures of each of which are hereby incorporated by reference herein in their entirety.

BACKGROUND OF THE INVENTION

1. Field of the Invention

Exemplary embodiments of the present invention generally relate to a developing unit, an image forming apparatus including the developing unit, and a method of controlling amounts of toner used in the image forming apparatus, and more particularly, to a developing unit that employs a two-component developer including toner particles and carrier particles, an image forming apparatus including the developing unit, and a method of controlling amounts of toner used in the image forming apparatus incorporating the developing unit.

2. Discussion of the Related Art

Developing units that develop toner images for electrophotographic printing generally employ either a one-component developer or a two-component developer. While the one-component developer includes toner particles only, the two-component developer includes toner particles and magnetic carrier particles to which the toner particles adhere. The two-component developer is widely used in developing units where the two-component developer is mixed in a developer container so as to frictionally charge the two-component developer (hereinafter "developer") so that a developer bearing member holds the charged developer thereon. Toner particles or toner in the developer carried by the developer bearing member then selectively adhere to an electrostatic latent image so that a visible toner image can developed thereat.

FIG. 1 illustrates a schematic configuration of a dual-axis type of related-art developing unit 1000 employing a two-component dry developer in which the developer unit 1000 is viewed end-on, that is, with its axis perpendicular to the sheet of paper on which the drawing appears.

As shown in FIG. 1, the related-art developing unit 1000 that is generally incorporated in an image forming apparatus includes a developing roller 1001, a first path 1002, a second path 1003, a first conveyance screw 1004, and a second conveyance screw 1005.

The first conveyance screw 1004 and the second conveyance screw 1005 are provided in the first path 1002 and the second path 1003 in a long axial direction of the developing roller 1001 that serves as a developer bearing member. Developer travels in opposite directions in the first path 1002 and the second path 1003, propelled by the first conveyance screw 1004 and the second conveyance screw 1005 to the developing roller 1001 while being agitated. The dual-axis type developing unit 1000 collects any remaining developer and recirculates it.

When such an image forming apparatus continues to output images with a low image area ratio (i.e., images in which the actually printed area is small relative to the total surface area of the recording medium on which the image is formed), an amount of toner consumed is also relatively small while the toner remaining in the developing unit 1000 continues to be agitated by the conveyance screws. Such continuous agitation can subject the developer to excessive mechanical stress that degrades both toner and carrier. Specifically, such stress may, for example, cause additives to the toner to be embedded in the toner particles or the toner to be charged up or excessively charged. Deterioration of the toner and carrier in turn can cause such problems as a decrease in transfer efficiency of the toner from carrier to member/roller to final medium and a decrease in the amount of toner attracted to the developing roller, leading to inconsistent image density for output images.

By contrast, when images with a high image area ratio are continuously output, new toner, which corresponds to toner remaining in the developing unit 1000 until being consumed for image developing, may be conveyed to a development area without being agitated sufficiently. In this case, the toner receives less mechanical stress than the above-described case of continuously outputting images with a low image area ratio. However, the amount of charged toner tends to decrease, and it is likely that an insufficient amount of charged toner affects image density and/or color. If the above-described state continues, problems such as toner scattering and image background contamination may occur. In short, when toner agitation time/degree shifts or deviates significantly from a suitable range depending on the image area ratio, various problems may occur.

To eliminate the above-described drawbacks, one proposed approach suggests an image forming apparatus including a toner discharging mode. When images with a low image area ratio are continuously output, degraded toner particles are discharged by force and replaced with new toner particles.

Therefore, even when images with a low image area ratio are continuously output, the output images maintain a given optimum image density. However, the toner yield or productivity is degraded, causing an increase in running costs and posing a large problem for the environment.

Another proposed approach provides an image forming apparatus in which the charged-up toner and carrier are separated. Specifically, a video counter incorporated in the image forming apparatus counts an image area ratio, and when images with a low image area ratio are continuously output, compressed air is blown onto the surface of the developing roller to separate the charged-up toner and carrier for reuse of the separated toner.

According to the image forming apparatus with this technique, the separation of the charged-up toner and carrier can reduce the amount of charged toner. However, such an image forming apparatus may need to incorporate additional components such as a video counter, an air compressor, and a toner vacuum, resulting in an increase in size of the image forming apparatus, which runs counter to increasing market demand for more compact image forming apparatus and causes an increase in costs.

In sum, it is contemplated that problems of an image forming apparatus incorporating a developing unit with a two-component developer system occur for the following reasons: When a related-art image forming apparatus continuously outputs images with a low image area ratio, the toner contained in the developing unit receives a large amount of stress but most of the toner is left unconsumed for development. On the other hand, when the related-art image forming apparatus continuously outputs images with a high image area ratio, a large amount of new toner is replaced, and therefore most of the toner contained in the developing unit receives little stress but is consumed for development while insufficiently charged.

Accordingly, the following two possible countermeasures to decrease mechanical or agitation stress per toner particle suggest themselves:

(1) Increasing the amount of developer in the developing unit or increasing the capacity of the developing unit; and (2) Increasing the toner density.

However, (1) cannot avoid an increase in size of the image forming apparatus, and thus is not suitable for image forming apparatuses with a space limitation. On the other hand, when a toner density with a carrier coverage over 100% is set as in (2), some toner cannot contact the carrier and thus cannot be charged. Therefore, in principle (2) is not an option in an electrophotographic developing unit in which electrostatic force is used. Further, no large toner increase can be expected within the above-described limitations, and therefore it is difficult to expect any great decrease in toner deterioration.

Further, as noted above, a developing unit of the dual-axis type shown in FIG. 1 employs a configuration in which developer that has been supplied to a developer bearing member is returned to a supply/conveyance path of the developer. That is, developer that has passed a development area in which a certain amount of toner on the surface of the developer bearing member has been consumed to develop an image and developer that has yet to be supplied to the surface of the developer bearing member are mixed in the supply/conveyance path. Therefore, the amount of developer that has passed the development area may be greater as the developer is conveyed further downstream in a direction of conveyance of the supply/conveyance path and the toner is consumed in the process of forming an image. In other words, the toner density of the developer supplied to the developer bearing member may gradually decrease as the developer is conveyed further downstream in the direction of conveyance of the supply/conveyance path. Accordingly, a difference in output toner densities arises between upstream side and downstream sides in the direction of supply and conveyance of the developer, and this difference can adversely affect image quality.

To eliminate the above-described drawbacks, providing an image forming apparatus including a developing unit with a collection/conveyance path has been proposed. That is, separate from the supply/conveyance path to supply developer to a developer bearing member, the developing unit includes a collection/conveyance path where the developer that has passed the development area is collected to a new toner inlet that is a starting portion of the supply/conveyance path. According to the image forming apparatus including this approach, inconsistency in the densities of output images can be reduced. However, this approach cannot avoid the toner deterioration such as the above-described mechanical stress due to agitation and toner charge-up.

SUMMARY OF THE INVENTION

Exemplary aspects of the present invention have been made in view of the above-described circumstances.

Exemplary aspects of the present invention provide a developing unit that can reduce deterioration in developer and control respective amounts of collected toner and new toner to develop and output high quality images regardless of an image area ratio of an image to be developed.

Another exemplary aspects of the present invention provide an image forming apparatus to which the above-described developing unit is incorporated.

Yet another exemplary aspects of the present invention provide a method of controlling amounts of toner used in image forming apparatus to which the above-described developing unit is incorporated.

In one exemplary embodiment, a developing unit includes a developer case to accommodate a two-component developer including toner particles and carrier particles, a developer bearing member that is disposed in the developer case and bears the two-component developer to supply to an electrostatic latent image for development of the electrostatic latent image into a visible image, a developer supply path formed inside the developer case to supply the two-component developer along an axial direction of the developer bearing member, an agitation and conveyance member disposed in the developer supply path to agitate and convey the two-component developer, a toner collecting mechanism to collect toner particles from the two-component developer remaining on the developer bearing member after development, and a collected toner conveyance path formed inside the developer case and separated from the developer supply path, comprising a collected toner conveying member disposed therewithin to convey toner collected by the toner collecting mechanism. The collected toner conveyance path and the developer supply path are arranged in communication with each other in the vicinity of one end of the collected toner conveyance path in a direction of conveyance of collected toner so as to recirculate toner unused for development.

The sum of a total amount of toner particles in the toner collecting mechanism and the collected toner conveyance path and a total amount of toner particles electrostatically coupled with the carrier particles may have a coverage of at least 100% with respect to a total amount of carrier particles.

The toner collecting mechanism may collect toner not during image development with toner moving from the developer bearing member.

The above-described toner collecting mechanism may include a toner collection roller to electrostatically collect toner particles remaining on the developer bearing member, and a toner collection member to collect toner particles from a surface of the toner collection roller.

When a toner collection ratio is converted to an image area ratio of an image to a total surface area of a recording medium based on a weight of collected toner, the toner collection mechanism may set a bias voltage of the toner collection roller to an image area ratio of at least 5% for printing one given transfer medium as a reference.

The above-described developing unit may further include a toner collection hopper provided in the vicinity of an end portion of the collected toner conveyance path in a direction of conveyance of toner to contain toner not supplied to the developer bearing member for image forming and toner collected by the toner collecting mechanism.

The toner collecting mechanism may collect toner from an entire image area in a longitudinal direction of the developer bearing member.

The toner collecting mechanism may collect only from a downstream side of the developer bearing member in a direction of conveyance of the developer.

The above-described developing unit may further include a collected developer conveyance path including a collected developer conveyance member separated from the agitation and conveyance member to convey the developer collected from a developer releasing area where the developer is separated from the developer bearing member using a magnetic repulsion force. The collected developer conveyance path may convey developer in a same direction as a direction of conveyance of collected toner in the collected toner conveyance path. The collected developer conveyance path, the collected toner conveyance path, and the developer supply path may be disposed in communication with each other in the vicinity of an end portion of the developing unit in a direction of conveyance of the collected toner and the collected developer so as to recirculate toner and developer unused for development.

The toner collecting mechanism may be toner collecting mechanism is disposed downstream from an image development area and upstream from the developer releasing area, and disposed in proximity to the developer bearing member in a direction of rotation of the developer bearing member.

Further, in one exemplary embodiment, an image forming apparatus includes an image bearing member to bear an electrostatic latent image on a surface thereof, and the above-described developing unit.

The above-described image forming apparatus may further include a new toner container to contain new toner, a new toner supply path in communication with the new toner container and the developing unit to supply the new toner to the developing unit, a new toner conveyance member mounted on the new toner supply path to convey the new toner and control an amount of supply of the new toner, a collected toner conveyance member disposed in the collected toner conveyance path to convey the collected toner and control an amount of supply of collected toner, and a control unit to control an amount of conveyance of toner by the new toner conveyance member, an amount of conveyance of toner by the collected toner conveyance member, and an amount of collected toner collected by the toner collecting mechanism. The control unit may control an amount of collected toner per unit of time such that, when an amount of collected toner per unit of time where the toner is transferred from the developing unit to the image bearing member and consumed at a development area is smaller than the reference amount, the amount of collected toner per unit of time collected by the toner collecting mechanism is conveyed by the collected toner conveyance member and exceeds than the amount of supply of collected toner to be supplied to the developer supply path, and when the amount of consumed toner per unit of time is greater than the reference amount, the amount of collected toner per unit of time is reduced to below the amount of supply of collected toner.

When the amount of consumed toner per unit of time is equal to or smaller than the reference amount, the controlling unit may make the amount of collected toner per unit of time equal to or greater than a difference between the reference amount and the amount of consumed toner per unit of time.

When the amount of consumed toner per unit of time is equal to or smaller than the reference amount, in a supply of toner to the developer supply path, new toner may be supplied by using the new toner conveyance member instead of supplying the collected toner by using the collected toner conveyance member.

When the amount of consumed toner per unit of time is greater than the reference amount, the toner collecting mechanism may not be used for collecting toner.

When the amount of consumed toner per unit of time is greater than the reference amount, in a supply of toner to the developer supply path, the collected toner only may be supplied by using the collected toner conveyance member instead of supplying new toner by using the new toner conveyance member.

When the amount of consumed toner per unit of time is greater than the reference amount, in a supply of toner to the developer supply path, the control unit supplies new toner by using the new toner conveyance member to determine the amount of supply of new toner per unit of time as a reference amount, and makes the amount of collected toner per unit of time to a difference between the amount of consumed toner per unit of time and the reference amount.

A reference amount A may be specified within a range satisfying an equation, $$0.02 \cdot x \cdot T/t \leqq A < 0.07 \cdot x \cdot T/t,$$

where "x" represents an amount of consumed toner [gram] when one solid image is output, "T" represents the unit time [seconds] corresponding to a reference period of time in which the control unit controls at least one of toner collection and supply of collected toner, and "t" represents a time [seconds] required for printing one image in continuous image printing.

The above-described image forming apparatus may further include a toner-empty sensor to detect an empty state of collected toner in the collected toner conveyance path and a toner-full sensor to detect a full state of collected toner in the collected toner conveyance path, such that (1) when the amount of consumed toner an is equal to or smaller than a reference amount A corresponding the reference amount and neither the toner-empty sensor nor the toner-full sensor detects either an empty state or a full state of the collected toner, respectively, the amount of collected toner $b_n$, the amount of supply of collected toner $c_n$, and the amount of supply of new toner $d_n$ may be calculated according to Equation Set (1), $$b_n = A - a_n + \alpha,\ c_n = \alpha, \text{ and } d_n = A \qquad \text{Equation Set (1)},$$

(2) when the amount of consumed toner an is greater than a reference amount A corresponding the reference amount and neither the toner-empty sensor nor the toner-full sensor detects either an empty state or a full state of the collected toner, respectively, the amount of collected toner $b_n$, the amount of supply of collected toner $c_n$, and the amount of supply of new toner $d_n$ may be calculated according to Equation Set (2), $$b_n = \beta,\ c_n = a_n - \gamma + \beta, \text{ and } d_n = \gamma \qquad \text{Equation Set (2)},$$

(3) when the amount of consumed toner $a_n$ is equal to or smaller than a reference amount A corresponding the reference amount and the toner-empty sensor has detected an empty state of the collected toner, the amount of collected toner $b_n$, the amount of supply of collected toner $c_n$, and the amount of supply of new toner $d_n$ may be calculated according to Equation Set (3), $$b_n = A - a_n + \alpha,\ c_n = 0, \text{ and } d_n = A + \alpha \qquad \text{Equation Set (3)},$$

(4) when the amount of consumed toner $a_n$ is greater than a reference amount A corresponding the reference amount and the toner-empty sensor has detected an empty state of the collected toner, the amount of collected toner $b_n$, the amount of supply of collected toner $c_n$ and the amount of supply of new toner $d_n$ may be calculated according to Equation Set (4), $$b_n = \beta,\ c_n = 0, \text{ and } d_n = a_n + \beta \qquad \text{Equation Set (4)},$$

(5) when the amount of consumed toner $a_n$ is equal to or smaller than a reference amount A corresponding the reference amount and the toner-full sensor has detected a full state of the collected toner, the amount of collected toner $b_n$, the amount of supply of collected toner $c_n$, and the amount of supply of new toner $d_n$ may be calculated according to Equation Set (5), $$b_n = A - a_n + \alpha,\ c_n = A + \alpha, \text{ and } d_n = 0 \qquad \text{Equation Set (5)},$$

(6) when the amount of consumed toner $a_n$ is greater than a reference amount A corresponding the reference amount and the toner-full sensor has detected a full state of the collected toner, the amount of collected toner $b_n$, the amount of supply of collected toner $c_n$, and the amount of supply of new toner $d_n$ may be calculated according to Equation Set (6), $$b_n=\beta,\ c_n=a_n+\beta,\ \text{and}\ d_n=0 \qquad \text{Equation Set (6)},$$

where "α", "β", and "γ" represent respective arbitrary values, and "A" represents a reference amount corresponding to an average amount of consumed toner, and the control unit may control to obtain the calculated amounts.

Further, in one exemplary embodiment, a method for controlling amounts of toner in the above-described image forming apparatus includes (1) calculating the amount of collected toner $b_n$, the amount of supply of collected toner $c_n$, and the amount of supply of new toner $d_n$ according to Equation Set (1), when the amount of consumed toner $a_n$ is equal to or smaller than a reference amount and a toner-empty sensor and a toner-full sensor detect neither an empty state nor a full state of the collected toner, $$b_n=A-a_n+\alpha,$$

$$c_n=\alpha,\ \text{and}$$

$$d_n=A \qquad \text{Equation Set (1)};$$

(2) calculating the amount of collected toner $b_n$, the amount of supply of collected toner $c_n$, and the amount of supply of new toner $d_n$ are calculated according to Equation Set (2) when the amount of consumed toner $a_n$ is greater than the reference amount and the toner-empty sensor and the toner-full sensor detect neither an empty state nor a full state of the collected toner, $$b_n=\beta,$$

$$c_n=a_n-\gamma+\beta,\ \text{and}$$

$$d_n=\gamma \qquad \text{Equation Set (2)};$$

(3) calculating the amount of collected toner $b_n$, the amount of supply of collected toner $c_n$, and the amount of supply of new toner $d_n$ according to Equation Set (3) when the amount of consumed toner $a_n$ is equal to or smaller than a reference amount A corresponding the reference amount and the toner-empty sensor has detected an empty state of the collected toner, $$b_n=A-a_n+\alpha,$$

$$c_n=0,\ \text{and}$$

$$d_n=A+\alpha \qquad \text{Equation Set (3)};$$

(4) calculating the amount of collected toner $b_n$, the amount of supply of collected toner $c_n$, and the amount of supply of new toner $d_n$ according to Equation Set (4) when the amount of consumed toner $a_n$ is greater than a reference amount corresponding the reference amount and the toner-empty sensor has detected an empty state of the collected toner, $$b_n=\beta,$$

$$c_n=0,\ \text{and}$$

$$d_n=a_{n+\beta} \qquad \text{Equation Set (4)};$$

(5) calculating the amount of collected toner $b_n$, the amount of supply of collected toner $c_n$, and the amount of supply of new toner $d_n$ are calculated according to Equation Set (5) when the amount of consumed toner $a_n$ is equal to or smaller than the reference amount and the toner-full sensor has detected a full state of the collected toner, $$b_n=A-a_n+\alpha,$$

$$c_n=A+\alpha,\ \text{and}$$

$$d_n=0 \qquad \text{Equation Set (5)};$$

(6) calculating the amount of collected toner $b_n$, the amount of supply of collected toner $c_n$, and the amount of supply of new toner $d_n$ are calculated according to Equation Set (6) when the amount of consumed toner $a_n$ is greater than the reference amount and the toner-full sensor has detected a full state of the collected toner, $$b_n=\beta,$$

$$c_n=a_n+\beta,\ \text{and}$$

$$d_n=0 \qquad \text{Equation Set (6)},$$

where "α", "β", and "γ" represent respective arbitrary values, and "A" represents a reference amount corresponding to an average amount of consumed toner; and (7) controlling to obtain the calculated amounts.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6 is a top view illustrating a schematic configuration of a developing unit according to a second exemplary embodiment of the present invention;

FIG. 15 is a plan view of a schematic structure of the toner cartridge incorporated in the color printer of FIG. 2;

DETAILED DESCRIPTION OF THE PREFERRED EMBODIMENTS

Figure 1:
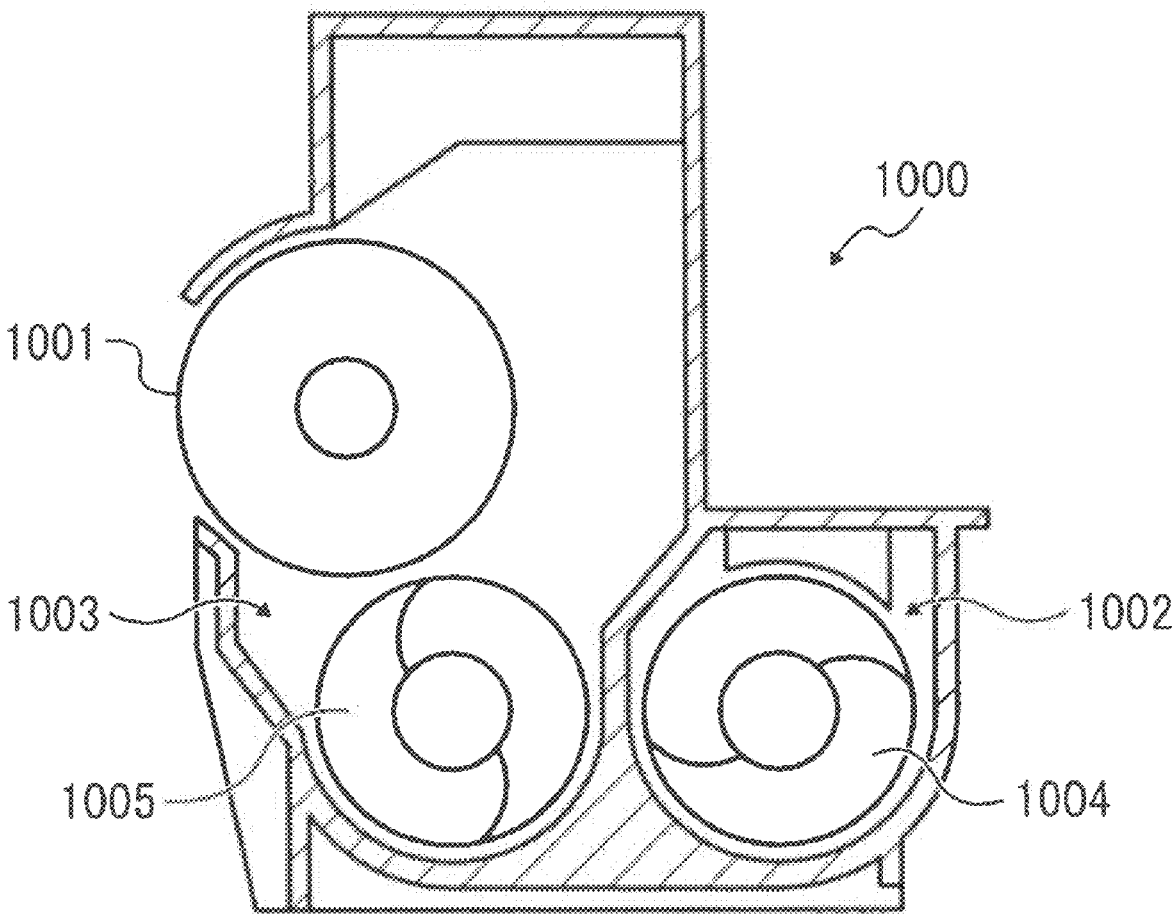
FIG. 1 BACKGROUND ART
FIG. 1 is a cross-sectional view showing a schematic configuration of an example of a related-art development apparatus of a dual-axis type.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
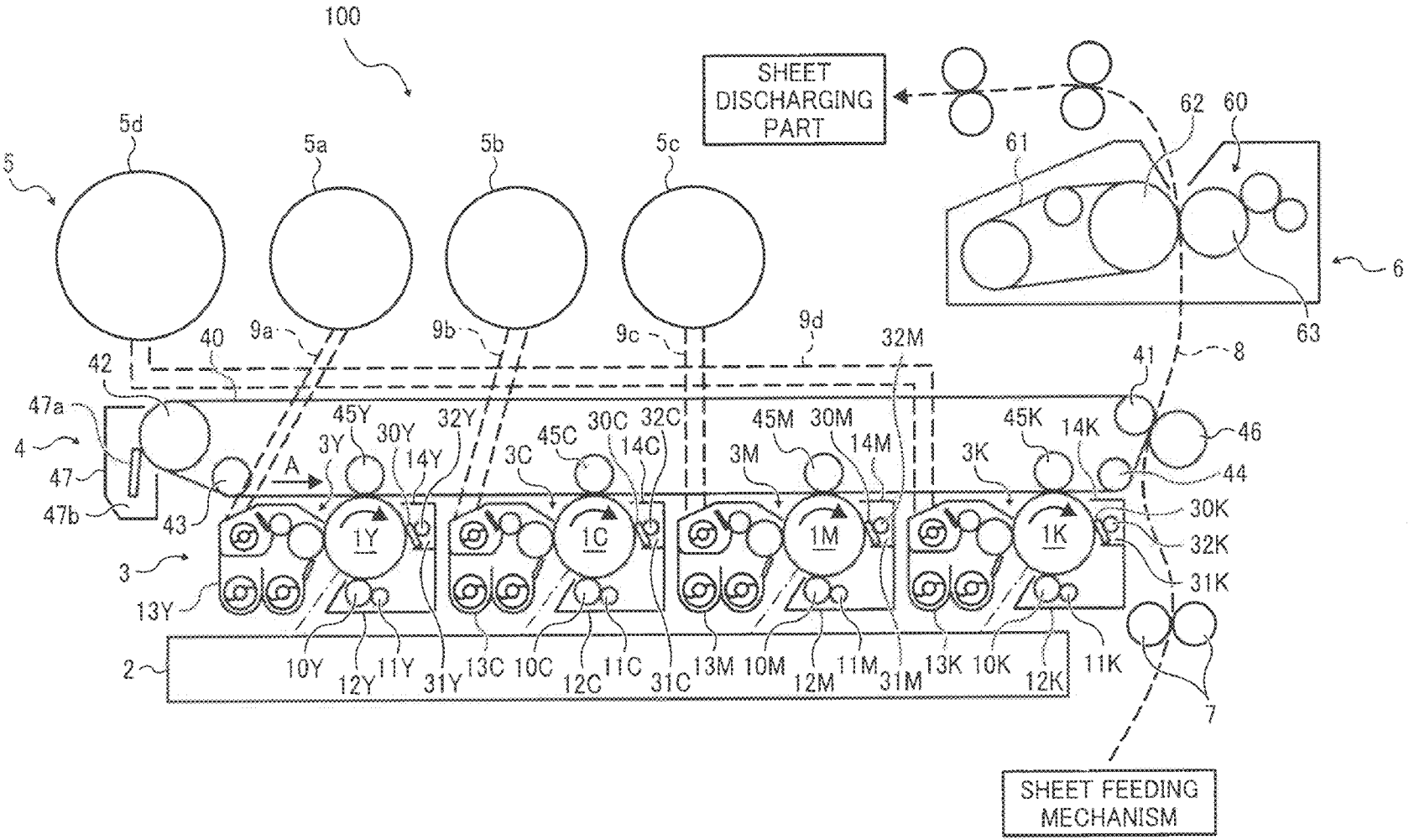
FIG. 2 is a view showing a configuration of a main part of an image forming apparatus according to an exemplary embodiment of the present invention.

Referring to FIG. 2, a schematic configuration of a color printer 100 is described as an exemplary embodiment of the present invention. FIG. 2 illustrates a main part of the color printer 100.

The color printer 100 serves as an image forming apparatus and includes a four-tandem-type system with an intermediate transfer belt. The color printer 100 includes a main body, not shown, in a substantially chassis form, an optical writing unit 2, an image forming part 3, a transfer unit 4, a new toner container 5, and a fixing part 6.

The optical writing unit 2 is disposed substantially in the center of an inside of the main body. The image forming part 3 is positioned above the optical writing unit 2. The transfer unit 4 is disposed above the image forming part 3. The new toner container 5 is located above the transfer unit 4 and disposed substantially top of the main body. The fixing part 6 is disposed on the right-hand side of the new toner container 5 in FIG. 2 and also substantially on top of the main body.

The color printer 100 further includes a sheet feeding part, not shown, and a sheet discharging part, also not shown.

The sheet feeding part is disposed in a lower part of the main body and accommodates transfer members or recording media with a given size. The sheet feeding part feeds the transfer members according to instructions issued by a control unit incorporated in the main body. The sheet discharging part discharges the transfer member to which an image is fixed in the fixing part 6 and stacks the transfer members. Since the functions and configurations of the sheet feeding part and the sheet discharging part are widely known, detailed descriptions thereof will be omitted.

The color printer 100 further includes a pair of registration rollers 7 and a conveyance path 8.

The pair of registration rollers 7 stops and conveys the transfer member that is fed from the sheet feeding part to a secondary transfer nip, which will be described later, by adjusting a timing with a movement of formation of a color toner image. The conveyance path 8 is depicted with a dashed line and conveys the transfer member to a direction indicated by an arrow in FIG. 2.

The optical writing unit 2 serves as an exposure unit and scans and emits modulated laser light beams. The modulated laser light beams correspond to respective toner colors based on image data after color separation and are input from an external personal computer or PC. The optical writing unit 2 then alternatively exposures each uniformly charged circumferential surface of photoconductor drums, which will be described later. This exposure reduces surface potential on exposed parts of the circumferential surfaces of the photoconductor drums to form an electrostatic latent image on each photoconductor drums.

The image forming part 3 includes four image forming units 3Y, 3C, 3M, and 3K that correspond to yellow, cyan, magenta, and black toner colors, respectively. The image forming units 3Y, 3C, 3M, and 3K are disposed in the order of yellow toner, cyan toner, magenta toner, and black toner from upstream along a direction A of movement of an intermediate transfer member, which will be described later. These image forming units 3Y, 3C, 3M, and 3K include photoconductor drums 1Y, 1C, 1M, and 1K, respectively, and each of the photoconductor drums 1Y, 1C, 1M, and 1K serves as an image bearing member.

Various image forming units and components are disposed around the photoconductor drums 1Y, 1C, 1M, and 1K. Specifically, these image forming units and components are charging units 12Y, 12C, 12M, and 12K, developing units 13Y, 13C, 13M, and 13K, and cleaning units 14Y, 14C, 14M, and 14K are integrally provided to respective unit cases, not shown, of the image forming units 3Y, 3C, 3M, and 3K. The charging units 12Y, 12C, 12M, and 12K uniformly charge circumferential surfaces of the photoconductor drums 1Y, 1C, 1M, and 1K, respectively. The developing units 13Y, 13C, 13M, and 13K develop electrostatic latent images formed by the optical writing unit 2 on the circumferential surfaces of the photoconductor drums 1Y, 1C, 1M, and 1K to respective single toner images with corresponding color toners. The cleaning units 14Y, 14C, 14M, and 14K clean and collect residual toner particles remaining on the respective circumferential surfaces of the photoconductor drums 1Y, 1C, 1M, and 1K after transfer.

An order of the arrangement of the image forming units 3Y, 3C, 3M, and 3K are not limited to the above-described order, but different arrangements can be applied based on transfer conditions, accordingly.

The charging units 12Y, 12C, 12M, and 12K includes charge rollers 10Y, 10C, 10M, and 10K, and cleaning rollers 11Y, 11C, 11M, and 11K that clean the charge rollers 10Y, 10C, 10M, and 10K, respectively. The charge rollers 10Y, 10C, 10M, and 10K are rotatably supported by and attached to the respective unit cases, and contact with the photoconductor drums 1Y, 1C, 1M, and 1K while respectively rotating in a same direction as a direction of rotation of the photoconductor drums 1Y, 1C, 1M, and 1K, to charge the circumferential surfaces to a given polarity, which is a positive polarity or a negative polarity.

The cleaning units 14Y, 14C, 14M, and 14 mainly includes cleaning blades 30Y, 30C, 30M, and 30K, collected toner containers 31Y, 31C, 31M, and 31K, and conveyance screws 32Y, 32C, 32M, and 32K.

The cleaning blades 30Y, 30C, 30M, and 30K serve as cleaning member and can be held in contact with the photoconductor drums 1Y, 1C, 1M, and 1K, to scrape and collect residual toner adhering to and remaining on the photoconductor drums 1Y, 1C, 1M, and 1K, respectively, even after transfer.

The collected toner containers 31Y, 31C, 31M, and 31K are toner conveyance units that accommodate the residual toner particles collected from the photoconductor drums 1Y, 1C, 1M, and 1K, respectively (hereinafter "collected toner").

The conveyance screws 32Y, 32C, 32M, and 32K convey the collected toner accumulated in the collected toner containers 31Y, 31C, 31M, and 31K to wasted toner containers, not shown.

Details of the developing units 13Y, 13C, 13M, and 13K will be described later, as developing units according to an exemplary embodiment of the present invention.

The transfer unit 4 mainly includes an intermediate transfer belt 40, four belt supporting rollers 41, 42, 43, and 44, four primary transfer rollers 45Y, 45C, 45M, and 45K, and a secondary transfer roller 46.

The intermediate transfer belt 40 serves as an intermediate transfer member and an endless belt made of elastic resin. The four belt supporting rollers 41, 42, 43, and 44 are spanned around the intermediate transfer belt 40 to extend and support the intermediate transfer belt 40. The primary transfer rollers 45Y, 45C, 45M, and 45K are disposed opposite or facing the photoconductor drums 1Y, 1C, 1M, and 1K, respectively, while sandwiching the intermediate transfer belt 40 therebetween.

The belt supporting roller 41 corresponds to or plays a role of a drive roller that is connected to a drive unit, not shown. The secondary transfer roller 46 is disposed facing or opposed to the belt supporting roller 41 via the intermediate transfer belt 40. Hereinafter, the belt supporting roller 41 is also referred as a drive roller 41.

Further, a belt cleaning unit 47 is disposed in the vicinity of the belt supporting roller 42 to remove and collect residual toner (including patch patterns formed in the process of process control) remaining on a circumferential surface of the intermediate transfer belt 40 after secondary transfer.

The above-described primary transfer rollers 45Y, 45C, 45M, and 45K serve as contact-type transfer bias applying units that are disposed slightly shifted from respective positions directly facing the photoconductor drums 1Y, 1C, 1M, and 1K via the intermediate transfer belt 40. Specifically, the primary transfer rollers 45Y, 45C, 45M, and 45K are disposed slightly downstream from respective positions in a direction of conveyance of the intermediate transfer belt 40. The positional arrangement of the primary transfer rollers 45Y, 45C, 45M, and 45K is made to avoid problems due to void discharge or gap discharge. The primary transfer rollers 45Y, 45C, 45M, and 45K are connected to respective bias supplies, not shown, to apply respective primary transfer biases from an inner circumferential surface of the intermediate transfer belt 40.

The secondary transfer roller 46 is pressed by a pressing member, not shown, against the outer circumferential surface of the intermediate transfer belt 40 at a position facing the drive roller 41 to form a secondary transfer nip contact. The drive roller 41 serves as a contact-type transfer bias supplying unit and is connected to a bias supply, not shown.

Alternatively, the secondary transfer roller 46 can serve as a transfer bias supplying unit. In this case, a transfer bias with opposite polarity to a toner image to be transferred is applied.

The belt cleaning unit 47 includes a cleaning blade 47*a* and a toner container 47*b*. The cleaning blade 47*a* can be connected to and separate from the intermediate transfer belt 40. The toner container 47*b* stores toner scraped from the outer circumference of the intermediate transfer belt 40. The belt supporting roller 42 serves as a backup roller to which the cleaning blade 47*a* opposed in contact via the outer circumferential surface of the intermediate transfer belt 40. In the above-described configuration, the cleaning blade 47*a* scrapes residual toner from the intermediate transfer belt 40, the residual toner scraped and collected by the cleaning blade 47*a* is conveyed to store in the toner container 47*b*, and conveyance units such as the conveyance screws 32Y, 32C, 32M, and 32K convey the residual toner to respective wasted toner containers, not shown.

The new toner container 5 is provided to accommodate new toners corresponding to respective colors, which are yellow, cyan, magenta (three primary colors), and black, and includes four toner cartridges 5*a*, 5*b*, 5*c*, and 5*d* that are detachably attachable to the main body of the color printer 100. A positional arrangement of the four toner cartridges 5*a*, 5*b*, 5*c*, and 5*d* is not limited. The color printer 100 according to an exemplary embodiment of the present invention arranges the toner cartridges 5*a*, 5*b*, 5*c*, and 5*d* as shown in FIG. 2. Specifically, the toner cartridge 5*a* corresponds to yellow color toner, the toner cartridge 5*b* corresponds to cyan color toner, the toner cartridge 5*c* corresponds to magenta color toner, and the toner cartridge 5*d* corresponds to black color toner. Since the black color toner is mostly used in general, the size of the toner cartridge 5*d* is larger than the others.

The fixing part 6 includes a belt-type fixing unit 60 in which an image transferred onto a recording medium or a transfer sheet by the transfer unit 4 is fixed by applying heat and pressure. The fixing part 6 is separate from other parts or sections in the main body of the color printer 100 by a heat-resistant material such as a resin, so as reduce adverse affects caused due to heat or thermal conduction to other parts.

The belt-type fixing unit 60 includes a fixing belt 61, a fixing roller 62, and a pressure roller 63. The fixing belt 61 is an endless belt in which heat can be generated by a heat generating unit, not shown. The fixing roller 62 rotates the fixing belt 61. The pressure roller 63 is pressed against the fixing belt 61 on the fixing roller 62. The pressure roller 63 is biased by a biasing member, not shown, to be pressed against the fixing belt 61 at a position facing or opposed to the fixing roller 62 so as to form a fixing nip contact. At the fixing nip contact, heat conducted by the fixing belt 61 and pressure transmitted by the biasing member via the pressure roller 63 are applied to the transfer sheet conveyed thereto, so that the toner image, which is transferred onto the transfer sheet at the secondary transfer nip contact of the transfer unit 4, is fixed to the transfer sheet.

Next, a description is given of image forming operations performed by the color printer 100. Since the color printer 100 is used, the description of color image forming is made.

When a start button of image forming in the color printer 100 is pressed to start the image forming operations, the photoconductor drums 1Y, 1C, 1M, and 1K rotate in a clockwise direction as indicated by arrows in FIG. 2. At this time, the charging units 12Y, 12C, 12M, and 12K uniformly charge the respective circumferential surfaces of the photoconductor drums 1Y, 1C, 1M, and 1K to a given polarity, for example, a negative polarity. Then, the optical writing unit 2 emits the modulated laser light beams to the charged circumferential surfaces of the photoconductor drums 1Y, 1C, 1M, and 1K based on the image data after color separation to given colors. By so doing, respective electrostatic latent images are formed on the circumferential surfaces on the photoconductor drums 1Y, 1C, 1M, and 1K. Then, the developing units 13Y, 13C, 13M, and 13K develop these electrostatic latent images into respective visible single color toner images. When reaching the corresponding primary transfer rollers 45Y, 45C, 45M, and 45K, the respective toner images of respective colors receive primary transfer bias to be transferred onto the intermediate transfer belt 40 sequentially to form a four-color toner image.

The image forming operation for forming a monochrome image or black-and-white image may be performed with a photoconductor drum, such as the photoconductor 1K, for monochrome image forming only.

The transfer sheet conveyed from the sheet feeding part in the conveyance path 8 is conveyed to the secondary transfer nip contact at a timing controlled by the pair of registration rollers 7. At the secondary transfer nip contact, the drive roller 41 applies a secondary transfer bias to the transfer sheet so as to transfer the full-color toner image formed on the intermediate transfer belt 40 onto the transfer sheet. The transfer sheet carrying the full-color toner image thereon is conveyed to the fixing nip contact in the fixing part 6 where the fixing unit 60 applies heat and pressure to fix the full-color toner image to the transfer sheet. After the full-color toner image is fixed to the transfer sheet, the transfer sheet is discharged to the sheet discharging part to be stacked thereon.

Further, residual toner remaining on the surface of the intermediate transfer belt 40 after the secondary transfer is removed by the belt cleaning unit 47 together with residual toner for the patch pattern images for process control. Residual toner adhering to the photoconductor drums 1Y, 1C, 1M, and 1K after transfer is removed by the belt cleaning units 14Y, 14C, 14M, and 14K to be ready for a subsequent image forming operation. The residual toner particles removed by the cleaning unit 47 and the cleaning units 14Y, 14C, 14M, and 14K are conveyed to the wasted toner container, not shown, to be wasted.

Next, a description is given of new toner supplying operations performed by the color printer 100.

In the color printer 100, the toner cartridges 5*a*, 5*b*, 5*c*, and 5*d* and the developing units 13Y, 13C, 13M, and 13K are connected via new toner supply paths 9*a*, 9*b*, 9*c*, and 9*d*, respectively. The new toner supply paths 9*a*, 9*b*, 9*c*, and 9*d* are shown with dashed lines in FIG. 2. According to the above-described configuration, new toners of respective colors filled in the toner cartridges 5*a*, 5*b*, 5*c*, and 5*d* can be supplied to the developing units 13Y, 13C, 13M, and 13K, respectively.

Each of the new toner supply paths 9*a*, 9*b*, 9*c*, and 9*d* includes a supplying screw, not shown, which serves as a toner conveyance member and a residual toner sensor, not shown, which detects whether toner remains in the toner supply path. When the toner density detection unit provided in the developing unit 13, which corresponds any of the developing units 13Y, 13C, 13M, and 13K, detects that the toner density in the developing unit 13 is low, the supplying screw is rotated to supply a given amount of toner to the developing unit 13 via the new toner supply path 9, which can be any of the new toner supply paths 9*a*, 9*b*, 9*c*, and 9*d*.

Further, when detecting no toner or toner-empty that indicates there is no toner left in the new toner supply path 9, the residual toner sensor of the color printer 100 may send a request to the corresponding toner cartridge 5, which corresponds any of the toner cartridges 5*a*, 5*b*, 5*c*, and 5*d*, to supply toner therefrom. If the residual toner sensor does not detect any toner in the new toner supply path 9 even after a given period of time, it is determined that there is no toner left in the toner cartridge 5.

[Exemplary Embodiment 1]

Figure 3:
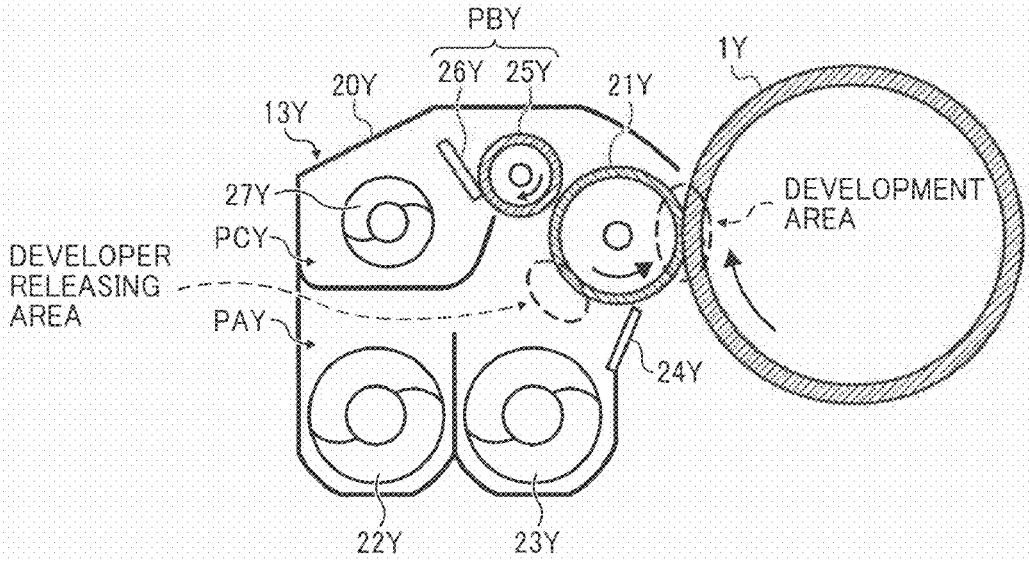
FIG. 3 is a cross-sectional view showing a schematic configuration of a developing unit according to a first exemplary embodiment of the present invention.
Figure 4:
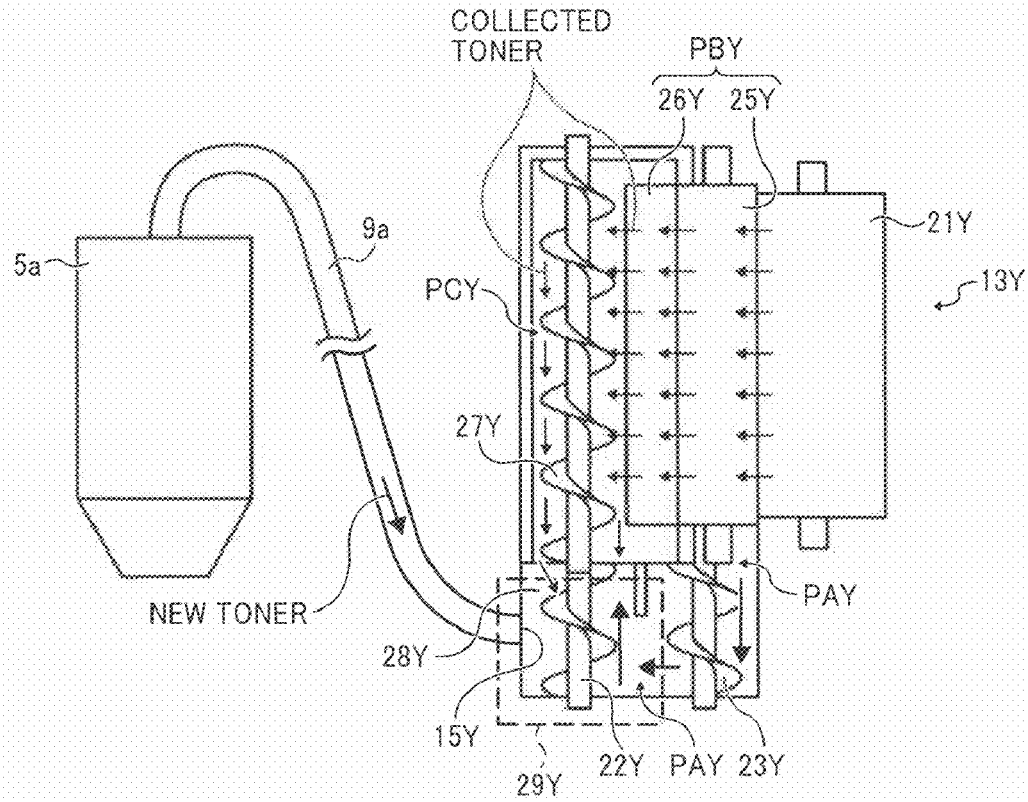
FIG. 4 is a top view showing a schematic configuration of the developing unit of FIG. 3.

Referring to FIGS. 3 and 4, detailed descriptions are given of the developing unit 13 (the developing units 13Y, 13C, 13M, and 13K incorporated in the color printer 100) according to a first exemplary embodiment or Exemplary Embodiment 1 of the present invention.

FIG. 3 is a vertical cross-sectional view for explaining a schematic structure of the developing unit 13Y according to Exemplary Embodiment 1, and FIG. 4 is a top view of the developing unit 13Y of FIG. 3 connected to the new toner supply path 9*a*.

Since the four developing units 13Y, 13C, 13M, and 13K have similar structures and functions, except that respective toners are of different colors, which are yellow, cyan, magenta and black toners, the discussion below will be focused on the developing unit 13Y and the image forming components incorporated therein.

The developing unit 13Y is a dual-axis type developing unit using a two-component dry developer, and includes a developer case 20Y that forms a housing thereof and contains the two-component developer including toner particles and magnetic carrier particles. The developer case 20Y includes a developing roller 21Y that is rotatably supported by the developer case 20Y and is disposed along and parallel to an axis of the photoconductor drum 1Y, with a given optimum gap therebetween (approximately 0.2 mm to 0.4 mm in Exemplary Embodiment 1).

The developing roller 21Y that serves as a developer bearing member includes a developing sleeve and a magnetic roller. The developing sleeve is made of non-magnetic material in a cylindrical shape and has an uneven circumferential surface, not shown. The magnetic roller is magnetized by multiple magnetic poles provided in the developing sleeve, and is connected to a bias supply so as to apply a developing bias to the developing roller 21Y.

The developer case 20Y includes a new toner inlet 15Y and a developer supply path PAY.

The new toner inlet 15Y is provided to supply new toner for yellow from the toner cartridge 5*a* via the new toner supply path 9*a*. In the developer supply path PAY, the new toner that is supplied from the new toner inlet 15Y and the magnetic carrier that is accommodated in the developer case 20Y are agitated so as to charge the developer to a desired amount of charge, and, at the same time, convey and supply the mixture of the agitated toner and carrier in an axial direction of the developing roller 21Y therethrough. Further, agitating screws 22Y and 23Y are provided in the developer supply path PAY. The agitating screws 22Y and 23Y serve as agitation and conveyance members that are rotatably disposed parallel to or along an axial direction of the developing roller 21Y. The agitating screws 22Y and 23Y charge the developer during agitation, convey the developer in opposite direction to each other for circulation, and supply the developer to the developing roller 21Y.

The developer case 20Y further includes a doctor blade 24Y disposed in a manner protruding toward the developing roller 21Y with a given gap therefrom. The doctor blade 24Y serves as a regulating member to regulate a thickness of developer carried on the surface of the developing roller 21Y.

The developer case 20Y further includes a toner collecting mechanism PBY and a collected toner conveyance path PCY.

The toner collecting mechanism PBY collects toner from the developer remaining on the developing roller 21Y even after passing a development area.

The collected toner conveyance path PCY is arranged separate from the developer supply path PAY in the developing unit 13Y to convey the collected toner with the toner collecting mechanism PBY to the new toner inlet 15Y (see FIG. 4).

The toner collecting mechanism PBY includes a toner collection roller 25Y and a collection blade 26Y.

The toner collection roller 25Y is electrically connected to the bias supply, not shown, provided to the main body of the color printer 100 to apply a voltage. The collection blade 26Y serves as a toner collection member that can contact to or separate from the circumferential surface of the toner collection roller 25Y to scrape toner remaining on the toner collection roller 25Y therefrom.

The toner collection roller 25Y is preferably formed by non-magnetic material such as an aluminum tube so as to position in the vicinity of the developing roller 21Y that includes the magnetic roller and contacts magnetic carrier. Further, it is preferable that a positional interval of the toner collection roller 25Y and the developing roller 21Y is substantially equal to a positional interval of the developing roller 21Y and the photoconductor drum 1Y (for example, 0.2 mm to 0.4 mm in this exemplary embodiment).

To increase a rate of collection of toner, the toner collecting mechanism PBY is preferably disposed facing or opposed to an entire distance in a longitudinal direction or an axial direction of the developing roller 21Y, and is located as shown in FIG. 4. Specifically, the toner collecting mechanism PBY is also disposed downstream from a position at which the photoconductor drum 1Y and the developing roller 21Y are opposed to each other (hereinafter referred to as a "development area") and upstream from an area where the developer is removed from the developing roller 21Y (hereinafter referred to as a "developer releasing area"), and disposed in proximity to the developing roller 21Y in a direction of rotation of the developing roller 21Y.

The collected toner conveyance path PCY includes a collected toner conveyance screw 27Y and a communication opening 28Y. The collected toner conveyance screw 27Y that serves as a collected toner conveying member is rotated by a drive unit, not shown, to convey the collected toner by the toner collecting mechanism PBY in a direction as indicated by arrows in FIG. 4.

The communication opening 28Y is arranged in the vicinity of a downstream end in a direction of conveyance of the collected toner conveyance screw 27Y so as to communicate with the developer supply path PAY.

Further, a toner container hopper 29Y, which is indicated by a dashed line in FIG. 4 and serves as a toner collection hopper, can be disposed in the vicinity of the communication opening 28Y to communicate with the new toner supply path 9*a* so that new toner and the collected toner can be agitated and supplied to the developer supply path PAY.

Next, a description is given of operations performed the developing unit 13, referring to FIGS. 3 and 4.

New toner supplied from the new toner inlet 15Y of the developer case 20Y is charged while being mixed by the agitating screws 22Y and 23Y with the magnetic carrier accommodated in the developer case 20Y and conveyed in a direction indicated by the arrows in FIG. 4 toward the developing roller 21Y. Developer that has reached the developing roller 21Y is attracted to the developing roller 21Y magnetically by a magnetic force of the magnetic roller in the developing roller 21Y. The developer carried on the developing roller 21Y is conveyed to the doctor blade 24Y according to the rotation of the developing roller 21Y where the doctor blade 24Y regulates the thickness of developer evenly to a given optimum amount. According to further rotation of the developing roller 21Y, the developer is conveyed to the development area. The developer is applied with a developing bias in the development area where the electrostatic force causes yellow toner corresponding to an electrostatic latent image formed on the photoconductor drum 1Y to transferred onto the electrostatic latent image to develop to a yellow toner image.

According to further rotation of the developing roller 21Y, toner that was not used in the development and carrier that conveyed the toner are conveyed to a position opposed to the toner collection roller 25Y. A given voltage is applied to the toner collection roller 25Y at a given timing so that only the toner is electrostatically attracted from the developer carried on the developing roller 21Y to an area across an entire width in a longitudinal direction of the toner collection roller 25Y. Toner and carrier not collected by the toner collection roller 25Y and still remaining on the developing roller 21Y are conveyed to the developer releasing area. In the developer releasing area, the toner and carrier are separated from the surface of the developing roller 21Y by repulsion of poles of the magnetic roller of the developing roller 21Y, and fall onto the agitating screws 22Y and 23Y to be agitated. The toner particles transferred onto the toner collection roller 25Y are scraped by the collection blade 26Y from the toner collection roller 25Y according to rotations of the toner collection roller 25Y, and are conveyed to the collected toner conveyance path PCY.

The toner particles conveyed to the collected toner conveyance path PCY are conveyed by the collected toner conveyance screw 27Y, and are returned via the communication opening 28Y to the developer supply path PAY. Alternatively, the toner particles can be conveyed to the toner container hopper 29Y attached to the developer case 20Y, where the collected toner and new toner are mixed. Then, the toner particles can be returned from the toner container hopper 29Y to the developer supply path PAY by a toner supplying unit, not shown.

The above-described explanation has been made for the developing unit 13Y with yellow toner for producing yellow toner images according to Exemplary Embodiment 1 of the present invention. However, as previously described, the units and components of the developing unit 13Y are similar to each of the developing units 13C, 13M, and 13K.

Further, the collection blade 26Y for scraping the developer or toner by contacting its edge to the developing roller 21Y has been described above as a toner collection member. However, different type of toner collection member can be applied to the present invention. For example, a brush roller or a scraper can be another toner collection member that physically collects the developer or toner from the developing roller 21Y. Alternatively, the toner collecting mechanism itself can change the bias to be applied to the toner collection roller, control an electrostatic suction force so as to separate or tear toner from the toner collection roller.

The toner container hopper 29Y can be attached to the developer case 20Y or, as previously described, can be placed outside the developer case 20Y.

The terms "new toner" used in the present invention means not only fresh and unused toner accommodated in the toner cartridges 5*a*, 5*b*, 5*c*, and 5*d* of the toner container 5, but also toner supplied from the new toner container into the developer supply path PAY to the developing roller 21Y. The terms "collected toner" indicate that a collected toner collected by the toner collection mechanism.

Figure 5:
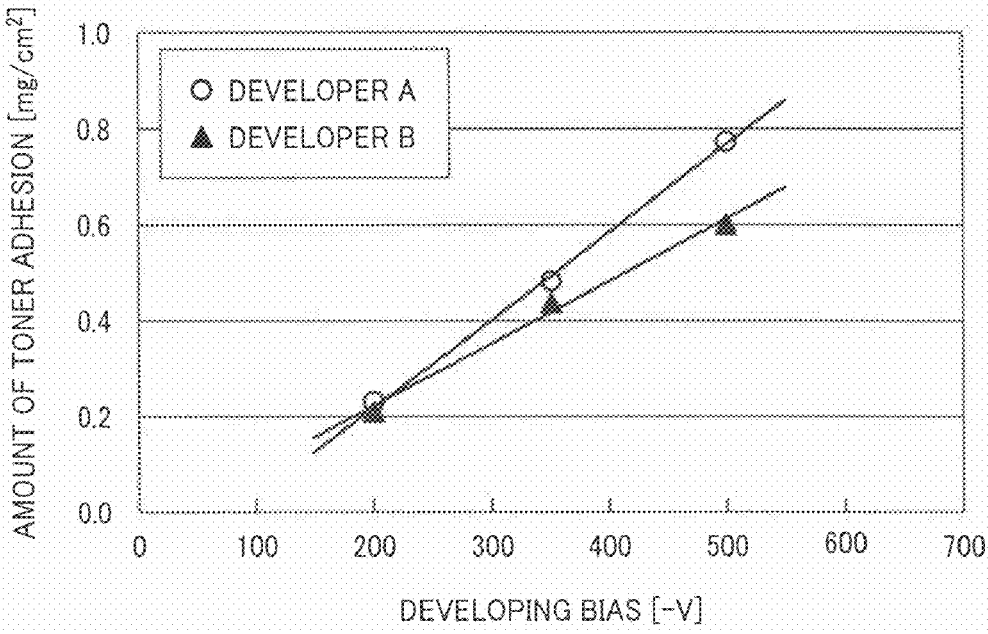
FIG. 5 is a graph showing a relation of an amount of toner adhesion and a developing bias of two different types of developers.

Next, a description is given of a bias voltage to be applied to the toner collection roller 25Y, referring to FIG. 5.

FIG. 5 is a graph showing a relation between amounts of toner adhesion and developing biases of two different developers (Developer A and Developer B). Specifically, the graph of FIG. 5 shows the amounts of toner adhesion and the developing biases when changing the developing biases by setting an applied bias voltage to the toner collection roller 25Y to −50V and rotating the toner collection roller 25Y in a forward direction at approximately twice a circumferential velocity of the developing roller 21Y.

A slope shown in the graph of FIG. 5 can vary depending on a combination of carrier type and toner type. However, the results show that the amount of toner adhesion per area to the toner collection roller 25Y increases in proportion to a difference of a bias voltage applied to the toner collection roller 25Y and the developing bias applied to the developing roller 21Y. That is, when a target image area ratio for toner collection is determined, an amount of toner adhesion can be obtained. By referring to the graph of FIG. 5 for the amount of toner adhesion obtained as above, the bias voltage to be applied to the toner collection roller 25Y can be obtained.

The developing unit 13Y according to an exemplary embodiment of the present invention employs Developer A in the graph of FIG. 5 as a developer used therein, and therefore the bias voltage to be applied to the toner collection roller 25Y corresponds to the developing bias plus 100V or greater. For example, when the developing bias is −500V, a bias voltage ranging from 0V to −400V may be applied to the toner collection roller 25Y.

In this exemplary embodiment, toner collection is performed with two rollers, the toner collection roller 25Y and the developing roller 21Y, which rotates in a forward direction at different speeds. However, the toner collection roller 25Y can rotate in an opposite direction to the developing roller 21Y.

As described below, when the toner collection roller 25Y electrically collects toner from the developing roller 21Y, it is more preferable to use toner manufactured by the following method with small variations in the particle diameters thereof or toner where the capacitance of each toner particle is substantially equal, when compared to toner pulverized toner with large variations in the particle diameters thereof. That is, toner particles having a shape such as a spherical shape, a substantially spherical shape, a rugby ball shape, and a pickled plum shape, which will be described later. The charge amount of each particle of toner remaining unused on the developing roller 21Y has much smaller variations than the charge amount of each particle of the pulverized toner. Therefore, the bias voltage can be set with some allowance when the toner collection roller 25Y performs a subsequent operation to electrostatically attract and collect toner remaining on the developing roller 21Y.

When the toner has large variations in each particle diameter, the charge amount of each of the toner particles may vary. Therefore, a bias voltage having a different polarity from toner charge may need to be set according to the toner having a large charge amount. However, when the bias voltage is set too large, the charge injection may occur to the toner having a small charge amount to cause the polarity of the toner to be reversed. As a result, the bias voltage of the toner may become same as the bias voltage of the toner collection roller 25Y, which cannot cause an effective attraction of toner to the toner collection roller 25Y. Therefore, toner cannot be attracted to collect when a bias voltage is too great or too small, resulting in less allowance in setting the bias voltage. In such a case, if fluctuations in temperature and humidity are considered, the setting of the bias voltage to be used in all environments will have further less allowance.

By contrast, if the toner particles for use in the image forming apparatus or the color printer 100 according to the present invention have the electrostatic capacitance substantially equal to each other, a wider area may not be affected by charge injection, and thus the bias voltage can be set by only considering changes due to environment.

According to the developing unit according to an exemplary embodiment of the present invention, the developing unit includes the toner collecting mechanism and the collected toner conveyance path so that toner can be recirculated in the developing unit. With the above-described configuration, a calculated coverage of the sum of the total amount of toner particles in the toner collecting mechanism and the collected toner conveyance path and the total amount of toner particles electrostatically adhered to carrier particles with respect to the total amount of carrier particles corresponds to 100% or greater. This calculated coverage can reduce the stress to one toner particle due to agitation, which can result in production of high-quality images regardless of the image area ratio of an image to be developed.

Specifically, since the theoretical limit of coverage of a related-art developing unit is 100%, the coverage cannot be increased above 100% even though the toner density is caused to increase, and the amount of toner that can be supplied to the developing unit.

By contrast, the developing unit 25Y according to an exemplary embodiment of the present invention can contain toner in the collected toner conveyance path PCY, which can set the theoretical coverage can be set to 100% or greater. With the above-described operation, stress per unit of toner particle is reduced, which may contribute to a reduction in deterioration of toner and a reduction in charge-up of toner.

Further, since it is not necessary to increase the amount of toner for development, any problem caused by a large amount of toner, such as toner scattering, can be avoided.

Equation 1 described below is to obtain the coverage (coverage of toner particles that circulate in the developing unit 21Y with respect to total of carrier particles):

$$\xi = \left(\frac{c}{1-c}\right) \times \left(\frac{R}{r}\right)^3 \times \left(\frac{\rho_c}{\rho_t}\right) \times \left(\frac{\sqrt{3}}{2\pi}\right) \times \left(\frac{r}{R+r}\right)^2. \quad \text{Equation 1}$$

The symbols used in Equation 1 represent as follows:

ξ: coverage, R: diameter of carrier particle [μm], r: radius of toner particle [μm], ρc: carrier true specific gravity [−], ρt: toner true specific gravity [−], c: toner density [wt %].

[Exemplary Embodiment 2]

Figure 6:
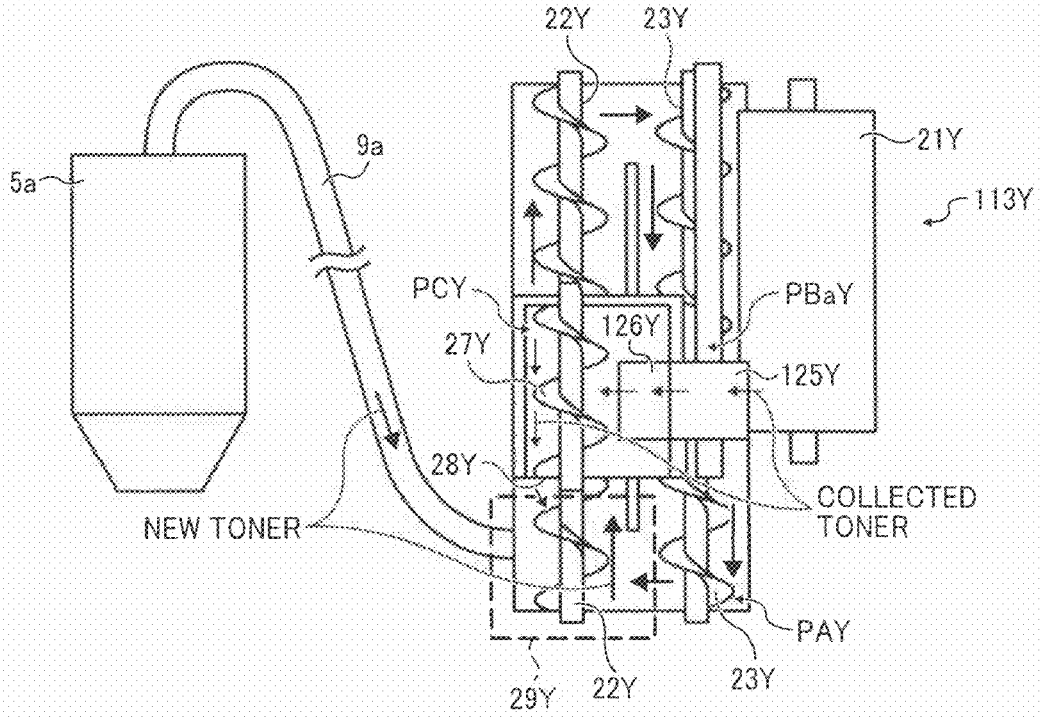
FIG. 6 is

Next, referring to FIG. 6, a description is given of a developing unit 113Y according to a second exemplary embodiment or Exemplary Embodiment 2 of the present invention.

FIG. 6 is a top view illustrating a schematic configuration of the developing unit 113Y according to Exemplary Embodiment 2 of the present invention. Elements or components of the developing unit 113Y according to Exemplary Embodiment 2 may be denoted by the same reference numerals as those of the developing unit 13Y according to Exemplary Embodiment 1 and the descriptions thereof are omitted or summarized.

As described above, the elements or components of the developing unit 113Y are similar in structure and functions to the elements or components of the developing unit 13Y, except that the developing unit 113Y includes a toner collecting mechanism PBaY. The toner collecting mechanism PBaY is disposed downstream from the development area and upstream from the developer releasing area, and disposed in proximity to the developing roller 21Y in a direction of rotation of the developing roller 21Y. The toner collecting mechanism PBaY includes a toner collection roller 125Y and a collection blade 126Y extends along an axial direction of the developing roller 21Y to cover a portion at a downstream side in a direction of conveyance of developer to the developing roller 21Y, while the toner collecting mechanism PBY of the developing unit 13Y according to Exemplary Embodiment 1 covers the entire width in the axial or longitudinal direction of the developing roller 21Y, as shown in FIG. 3.

With the above-described configuration, the toner collecting mechanism PBaY collects toner only in the downstream portion thereof in the direction of conveyance of developer to the developing roller 21Y. By so doing, the toner traveling a portion at an upstream side in the direction of conveyance of developer may not be collected by the toner collecting mechanism PBaY. Specifically, the toner density in the developer existing in the upstream portion in the direction of conveyance thereof is higher than the toner density in the developer existing in the downstream portion in the direction thereof. Since the toner collecting mechanism PBaY may not collect toner in the upstream portion thereof, the toner density in the developer traveling in the developing unit 113Y to be supplied to the developing roller 21Y may be maintained, thereby enhancing stability of image density.

[Exemplary Embodiment 3]

Figure 7:
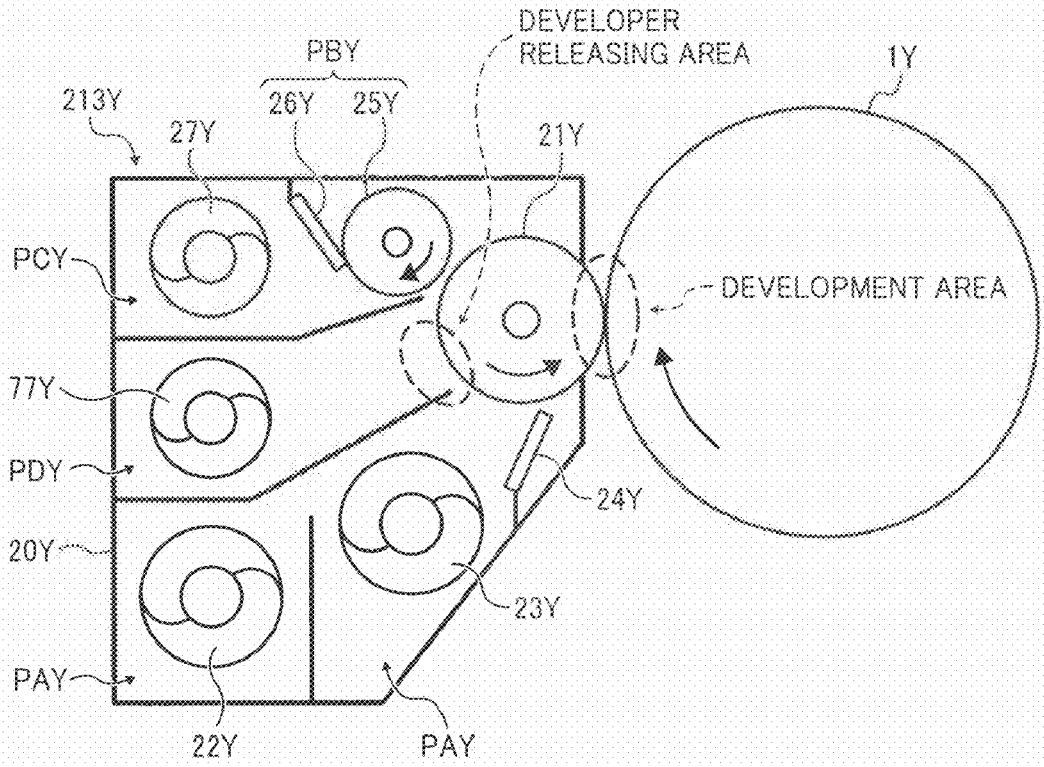
FIG. 7 is a vertical cross-sectional view illustrating a schematic configuration of a developing unit according to a third exemplary embodiment of the present invention.
Figure 8:
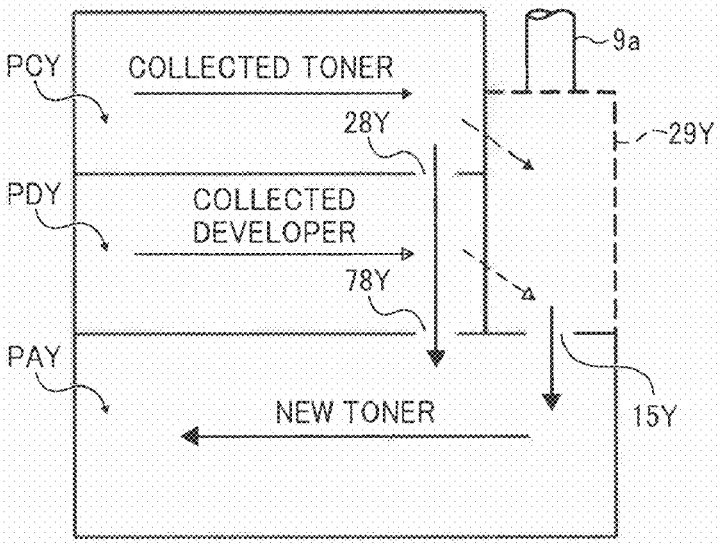
FIG. 8 is a left side view indicating a direction of conveyance of developer in the developing unit of FIG. 7.

Next, referring to FIGS. 7 and 8, descriptions are given of a developing unit 213Y according to a third exemplary embodiment or Exemplary Embodiment 3 of the present invention.

FIG. 7 is a vertical cross-sectional view illustrating a schematic configuration of the developing unit 213Y according to Exemplary Embodiment 3 of the present invention, and FIG. 8 is a left side view indicating a direction of conveyance of developer in the developing unit 213Y. Elements or components of the developing unit 213Y according to Exemplary Embodiment 3 may be denoted by the same reference numerals as those of the developing unit 13Y according to Exemplary Embodiment 1 and the descriptions thereof are omitted or summarized.

As described above, the elements or components of the developing unit 213Y according to Exemplary Embodiment 3 of the present invention are similar in structure and functions to the elements or components of the developing unit 13Y, except that the developing unit 213Y further includes a collected developer conveyance path PDY. The collected developer conveyance path PDY is separated from the developer supply path PAY to convey developer collected from the developer releasing area where the developing roller 21Y is applied with a repulsion force generated by the magnetic force so as to scrape the developer therefrom, to the new toner inlet 15Y in a same direction as the direction of conveyance of the collected toner in the collected toner conveyance path PCY.

The collected developer conveyance path PDY includes a collected developer conveyance screw 77Y that serves as a developer conveyance member. The collected developer conveyance screw 77Y is rotated by a drive unit, not shown, to convey the developer collected in the developer releasing area to a direction indicated by arrows in FIG. 8, which is the same direction as the direction of conveyance of collected toner in the collected toner conveyance path PCY.

The developing unit 213Y further includes a communication opening 78Y that is disposed at a downstream end portion in a direction of conveyance of the collected developer conveyance screw 77Y to communicate with the developer supply path PAY.

Therefore, the developer that is carried on the developing roller 21Y and conveyed to the developer releasing area is released from the surface of the developing roller 21Y by the repulsion of poles of the magnetic roller of the developing roller 21Y to fall in the collected developer conveyance path PDY to be collected. The developer collected as described above (hereinafter, "collected developer") is conveyed by the collected developer collection screw 77Y to the communication opening 78Y, as shown in FIG. 8. Then, the collected toner falls through the communication opening 78Y into the developer supply path PAY and is merged and mixed with the collected toner conveyed by the collected toner conveyance path PCY to be recirculated as unused developer. Thus, the developer supply path PAY, the collected toner conveyance path PCY, and the developer conveyance path PDY can communicate with each other in the vicinity of an end portion of the developing unit 21Y in a direction of conveyance of the collected toner and the collected developer so as to recirculate toner and developer unused for development.

Alternatively, the toner container hopper 29Y can be provided to communicate with the new toner supply path 9A as shown in FIG. 8. The toner container hopper 29Y can be communicated at an end portion in the direction of conveyance of developer in the collected toner conveyance path PBY so that the collected developer, new toner, and collected toner are agitated before supplying to the developer supply path PAY.

As described above, the developing unit 213Y according to Exemplary Embodiment 3 of the present invention further includes the collected developer conveyance path PDY that is separate from the developer supply path PAY. This configuration can set the developer collected from the developer releasing area apart from the developer carried by the developing roller and the developer newly supplied so as to return the collected developer to the new toner inlet 15Y. Therefore, a difference between the toner densities of developer in the upstream portion and the downstream portion in the direction of conveyance of the developer can be reduced. Accordingly, an image having any image area ratio can be developed to a high-quality image.

Next, descriptions are given of processes and results of four tests to examine and confirm the above-described effects.

[Test 1]

Test 1 was conducted with the developing unit 13 according to Exemplary Embodiment 1.

In Test 1, without performing development in which toner is transferred from the developing roller 21 to the photoconductor drum 1 and supply of new toner from the toner cartridge 5 to the toner container hopper 29, toner charge amount distributions were measured after different time periods elapsed.

Figure 9A:
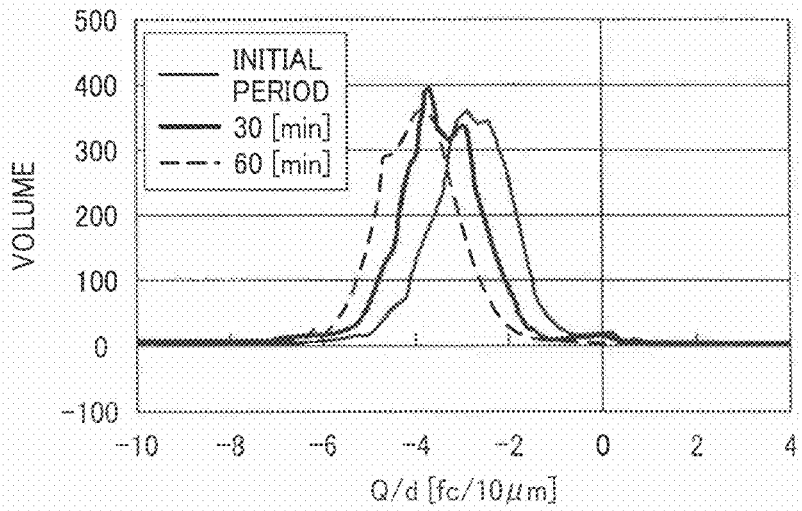
FIG. 9A is a graph showing a relation of toner agitation period and charged state of comparative examples.
Figure 9B:
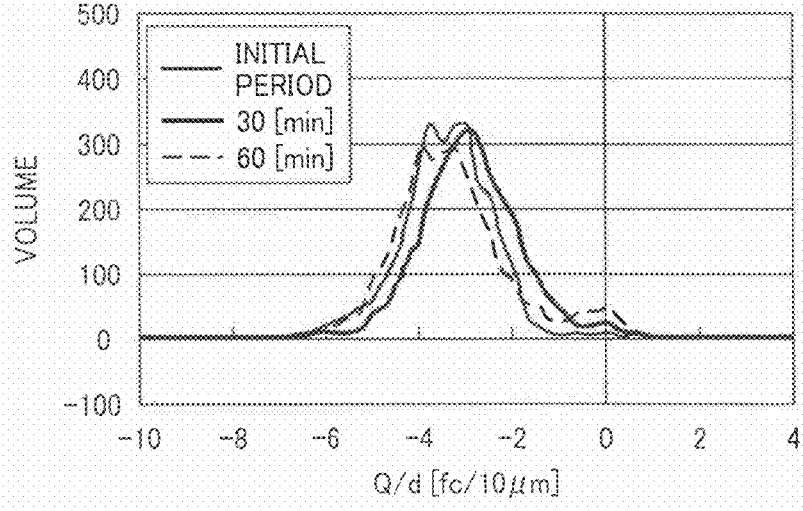
FIG. 9B is a graph showing a relation of toner agitation period and charged state of test examples.

FIGS. 9A and 9B are graphs each showing a relation of toner agitation period and charged state. FIG. 9A shows results of comparative examples, and FIG. 9B shows results of test examples. The measurements of toner charge amount distributions were measured using E-spart analyzer manufactured by Hosokawa Micron Corporation.

In the comparative examples, toner was not collected from the developing roller 21. In the test examples, toner was collected by applying a bias voltage to the toner collection roller 25, as described in Exemplary Embodiment 1, to separate and collect the toner on the toner collection roller 25 using the collection blade 26.

In Test 1, toner was collected from an image formed on an A4-size paper with 7% of the image area ratio. The amount of toner in the developer supply path A was 16 grams in weight, and total amount of toner circulated in the test example was 41 grams in weight.

As shown in FIGS. 9A and 9B, while the toner charge amount distribution shifted to a portion with greater charge amount as the agitation time elapsed in the comparative example, the toner particles were not charged up and the toner charge amount distribution was stable even after agitating for 60 minutes in the test example. Accordingly, the effect of a reduction in toner deterioration was observed.

Table 1 shows the results of calculated coverages in the comparative example and the test example in Test 1.

TABLE 1

| Symbol | Item [unit] | Value in Comparative Example | Value in Test Example |
|---|---|---|---|
| ξ | Coverage [%] | 42.2 | 109.2 |
| R | Radius of carrier [μm] | 17.5 | 17.5 |
| r | Radius of toner [μm] | 2.9 | 2.9 |
| ρc | True specific gravity of carrier [—] | 5.5 | 5.5 |
| ρt | True specific gravity of toner [—] | 1.2 | 1.2 |
| c | Toner density [wt %] | 7.0 | 16.3* |

*The coverage of this test example was over 100% because it was calculated as a weight ratio of total of toner particles including toner particles in the collected toner conveyance path with respect to total of carrier particles in the developing unit 13. The actual toner density in the developing unit 13, which is the weight ratio of toner electrostatically connected to carrier) was 7 wt % and the rest of toner, corresponding to 9.3 wt %, existed in the collected toner conveyance path.

[Test 2]

Test 2 was conducted with the developing unit 13 according to Exemplary Embodiment 1 and the developing unit 113 according to Exemplary Embodiment 2.

In Test 2, deviations of toner densities in a longitudinal direction of the developing roller 21 during toner collection were measured under the following conditions.

Figure 10:
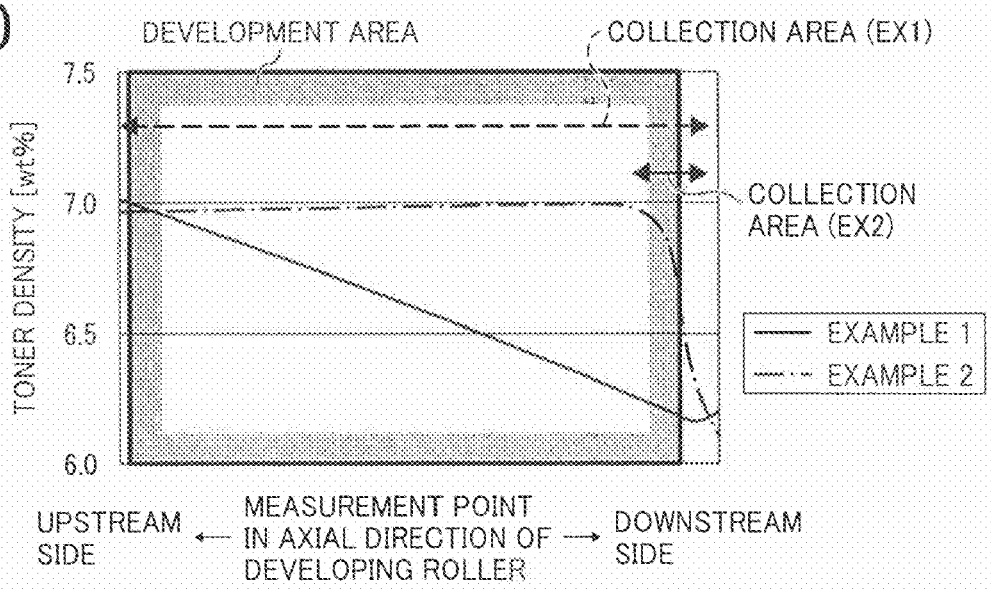
FIG. 10 is a graph showing distributions of the toner densities in a longitudinal direction of the developing roller according to the first and second exemplary embodiments.

FIG. 10 is a graph showing distributions of the toner densities in the longitudinal direction of the developing roller 21 according to Exemplary Embodiments 1 and 2.

Conditions common to Exemplary Embodiments 1 and 2 were: Total weight of developer: 350 g, Speed of conveyance of developer using agitating screw: 12.5 g/s, Linear velocity of developing roller: 500 mm/s, Linear velocity of photoconductor drum: 250 mm/s, Transfer member: A4 print sheet, Output speed of transfer member: 1 sheet/s, and Output image area ratio: 0%.

For Exemplary Embodiment 1, the applied voltage of the toner collection roller 25 was set such that the range of toner collection in the toner collecting mechanism is 307 mm along the entire area in the longitudinal direction or axial direction of the developing roller 21 as shown in FIG. 3, and that the collection ratio is 30% (collection speed is 82 mg/s).

For Exemplary Embodiment 2, the applied voltage of the toner collection roller 25 was set such that the range of toner collection in the toner collecting mechanism is 26 mm along the downstream area in the longitudinal direction or axial direction of the developing roller 21 as shown in FIG. 6 and that the collection ratio is 360% (collection speed is 986 mg/s).

As shown in FIG. 10, when the toner collection roller 25 collected toner across the entire area in the longitudinal direction of the developing roller 21 as in Exemplary Embodiment 1, the toner density on the further downstream area of the developing roller 21 was more decreased. It was considered that the above-described decrease in toner density occurred because (1) the developer was attracted from the agitation screw to the developing roller 21, (2) the developing roller 21 and the toner collection roller 25 consumed or collected the toner, which caused the toner density to decrease, and (3) the developer with the decreased toner density returned to the developer supply path, and the above-described operations (1) to (3) were repeated in the process of conveyance of developer from the upstream portion to the downstream portion of the agitating screws 22 and 23. It was contemplated, however, by collecting toner in the downstream area as in Exemplary Embodiment 2, the toner density can be decreased to enhance the stability of image density.

When the toner is collected along the entire area in the longitudinal direction of the developing roller 21 as in Exemplary Embodiment 1, the toner collection during the developing operation may cause deviations in image densities between left side and right side due to the difference in toner densities. However, when the toner collection is performed during an operation other than the toner collection or not during the developing operation, deviations in image densities due to the toner collection performed by the toner collecting mechanism can be reduced.

[Test 3]

To examine a relation of toner collection ratio and coarse image, the toner collection ratio was changed to perform visual examination on output images at the changed ratios.

Figure 11:
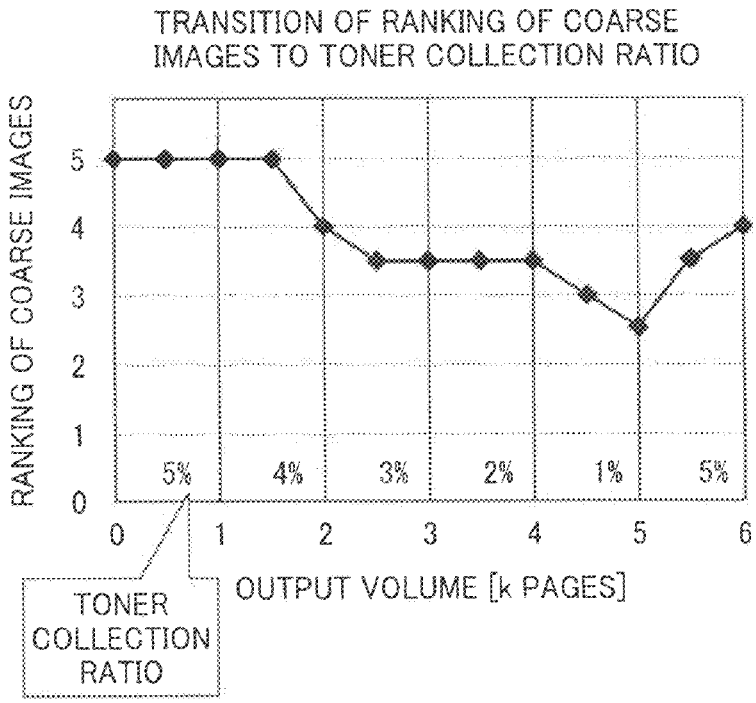
FIG. 11 is a graph showing examination ranks of coarse condition of solid images with respect to the toner collection ratio.

FIG. 11 is a graph showing examination ranks of coarse condition of solid images with respect to the toner collection ratio when sheets sequentially pass with no image output. The toner collection ratios were values that weights of collected toner were calculated to the image area ratios. That is, the toner collection ratio of 100% corresponds to a toner weight necessary to develop an entire solid image per time to develop one transfer sheet. For example, since A4 print sheets were sequentially output at one sheet per second in Exemplary Embodiments 1 and 2, the toner collection ratio of 100% was calculated to correspond to a speed of 274 mg/s, which was calculated as: amount of toner adhesion to a solid image on the photoconductor drum 1 (0.45 mg/cm$^2$)×image forming area (21×29 cm$^2$)/output transfer speed (one sheet/s).

Further, the coarse images were examined visually to rank the results to five grades from Rank 1 as the worst and Rank 5 as the best. Up to Rank 4 was accepted in the market.

As can be seen in the graph of FIG. 11, the coarse image is worsen with the toner collection ratios ranging 1% to 4% while the coarse image with the toner collection ratio of 5% is resulted as Rank 5. When the toner collection ratio is changed from 1% to 5 %, the result was recovered to the market-acceptable level after printing 1,000 sheets. That is, the collection of toner from an image having the image area ratio of 5% or greater can achieve an effect to reduce toner deterioration.

[Test 4]

Test 4 was conducted with the developing unit 13 according to Exemplary Embodiment 1 and the developing unit 213 according to Exemplary Embodiment 3.

In Test 4, time transitions of toner densities in developer were measured at an upstream portion, a midstream portion, and a downstream portion in a direction of conveyance of developer in the developer supply path under the following conditions.

Figure 12:
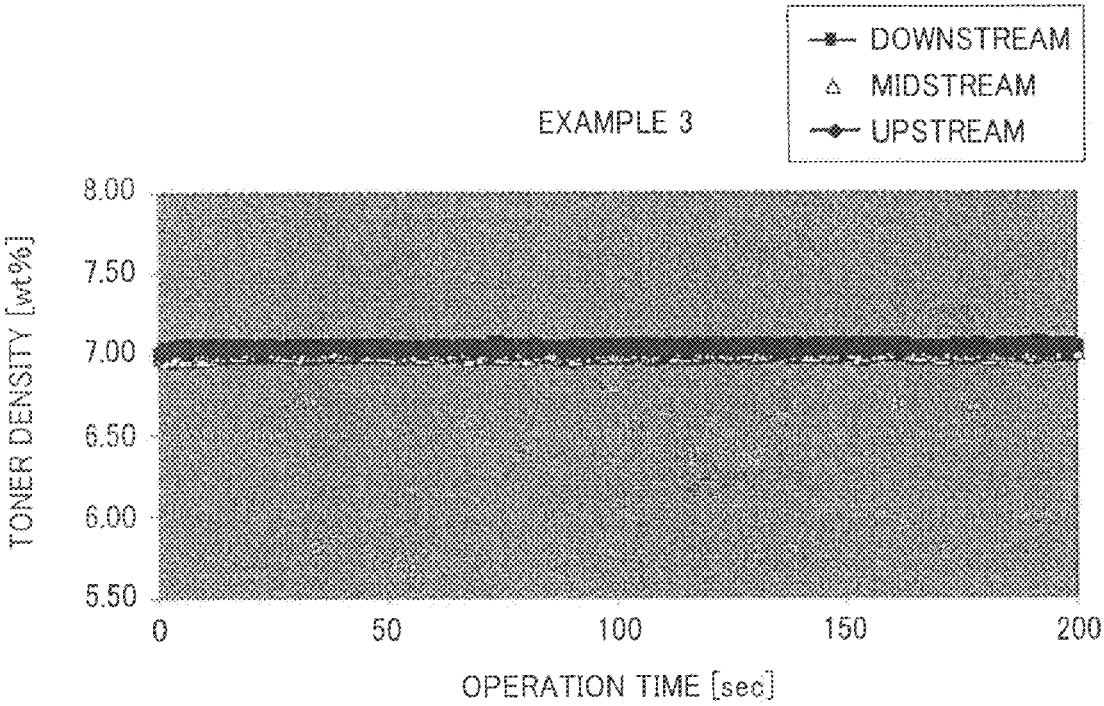
FIG. 12 is a graph showing time transitions of the toner densities in developer according to the third exemplary embodiment.
Figure 13:
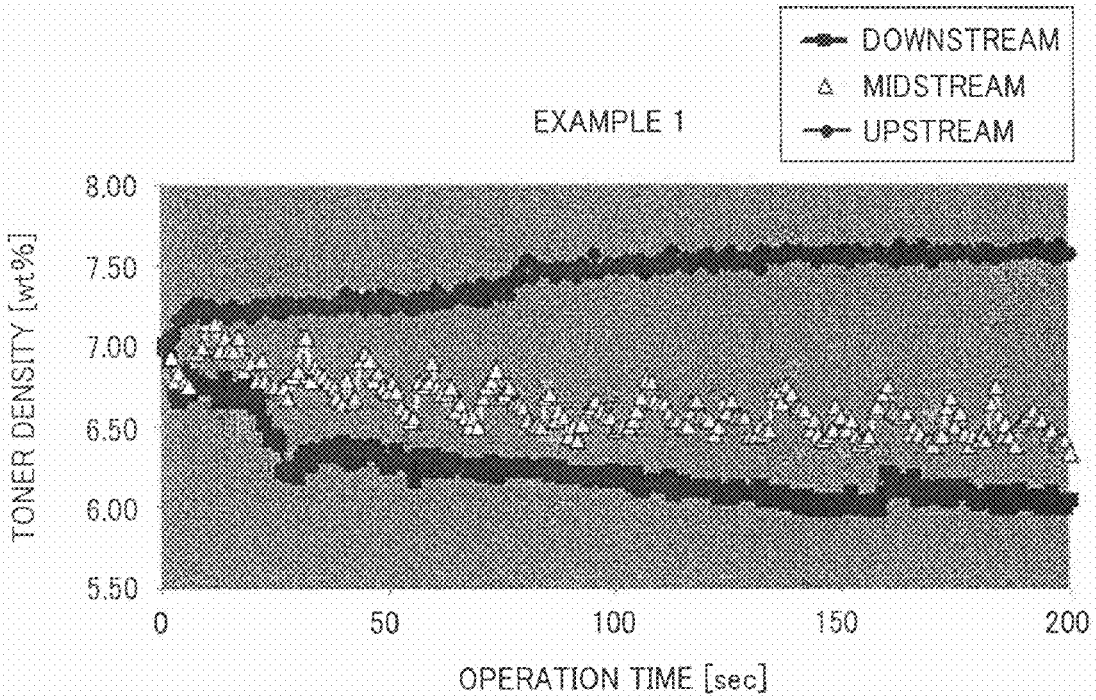
FIG. 13 is a graph showing time transitions of the toner densities in developer according to the first exemplary embodiment.
Figure 14:
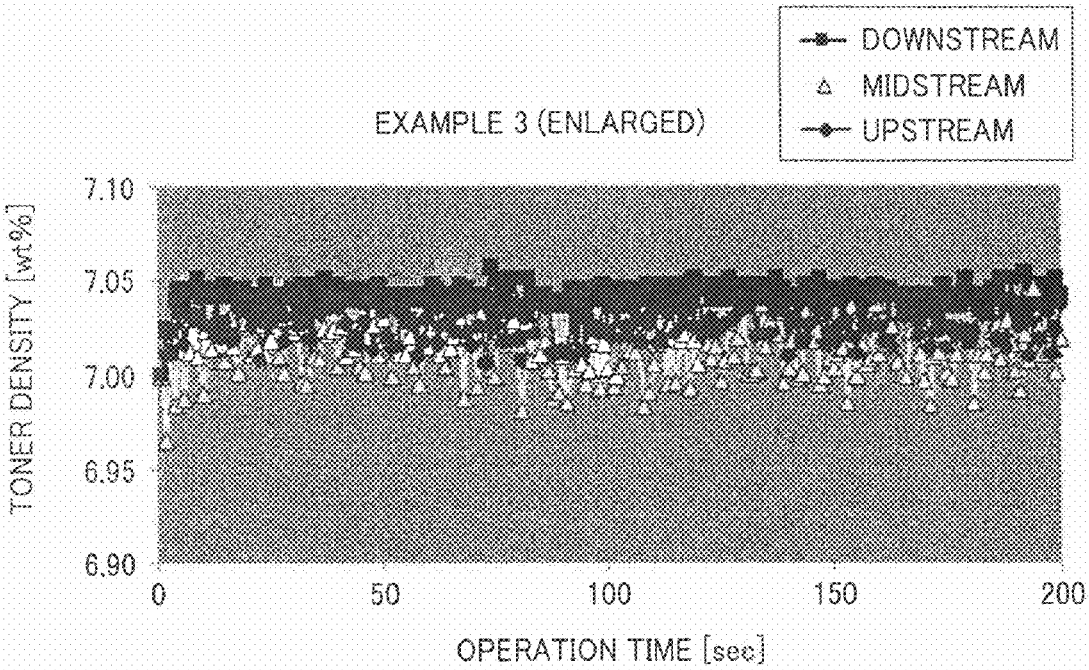
FIG. 14 is a graph showing an enlarged part of the graph of FIG. 12.

FIG. 12 is a graph showing time transitions of the toner densities in developer at the upstream portion, the midstream portion, and the downstream portion according to Exemplary Embodiments 1 and 3. FIG. 13 is a graph showing time transitions of the toner densities in developer at the upstream portion, the midstream portion, and the downstream portion according to the comparative example. FIG. 14 is a graph showing an enlarged part of the graph of FIG. 12.

Conditions common to Exemplary Embodiments 1 and 3 were: Total weight of developer: 350 g, Speed of conveyance of developer using agitating screw: 12.5 g/s, Linear velocity of developing roller: 500 mm/s, Linear velocity of photoconductor drum: 250 mm/s, Transfer member: A4 print sheet, Output speed of transfer member: 1 sheet/s, and Output image area ratio: 0%. The applied voltage of the toner collection roller 25 was set such that the range of toner collection in the toner collecting mechanism is 307 mm along the entire area in the longitudinal direction or axial direction of the developing roller 21 as shown in FIG. 3, and Collection ratio is 30% (collection speed: 82 mg/s).

Further, in Test 4, developer was collected in the collected toner conveyance path with the configuration of Exemplary Embodiment 3 while the collected toner conveyance path was not provided to the configuration of Exemplary Embodiment 1. With the configuration of Exemplary Embodiment 1, developer was not collected. That is, Test 4 was conducted such that the developer separated in the developer releasing area fell into the developer supply path.

As can be seen clearly in FIGS. 12 to 14, while deviations in image densities between left side and right side due to the difference in toner densities caused by the direction of conveyance of developer increased in Exemplary Embodiment 1, the deviations did not increase in Exemplary Embodiment 3. In the results of Exemplary Embodiment 3 shown in FIGS. 12 and 14, the toner densities gradually increased as the order of the downstream portion, the upstream portion, and the midstream portion. It is contemplated that these results were generated because the clearance or distance between the developing roller 21 and the photoconductor drum 1 was not constant. It is extremely difficult to maintain a constant clearance accurately. However, if the clearance is constant, the toner density at the upstream portion can be greater than the toner density at the midstream portion which is greater than the toner density at the downstream portion. Compared to the amount of deviations in image densities between the left side and the right side due to the difference in toner densities in Exemplary Embodiment 1 shown in the graph of FIG. 14, the differences among the toner densities at the upstream portion, the midstream portion, and the downstream portion shown in the graph of FIG. 12 are rather minor errors.

[Example Embodiment 4]

Referring to FIGS. 15 to 21B, descriptions are given of a developing unit 313Y according to a fourth exemplary embodiment or Exemplary Embodiment 4 of the present invention.

Elements or components of the developing unit 313Y according to Exemplary Embodiment 4 may be denoted by the same reference numerals as those of the developing unit 13Y according to Exemplary Embodiment 1 and the descriptions thereof are omitted or summarized.

The elements or components of the developing unit 313Y are similar in structure and functions to the elements or components of the developing unit 13Y, except that the developing unit 313Y further includes a central processing unit (CPU) or control unit 110, a toner density sensor SN1, a toner-full sensor SN2, and a toner-empty sensor SN3, which will be described later.

Figure 15:
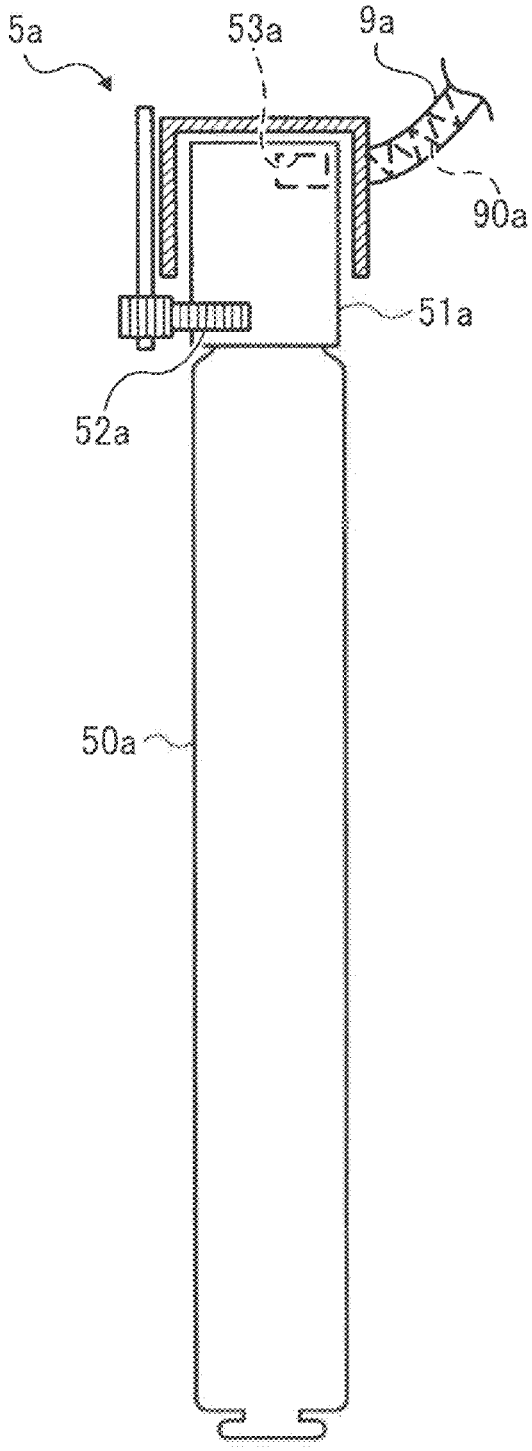
FIG. 15 is
Figure 16:
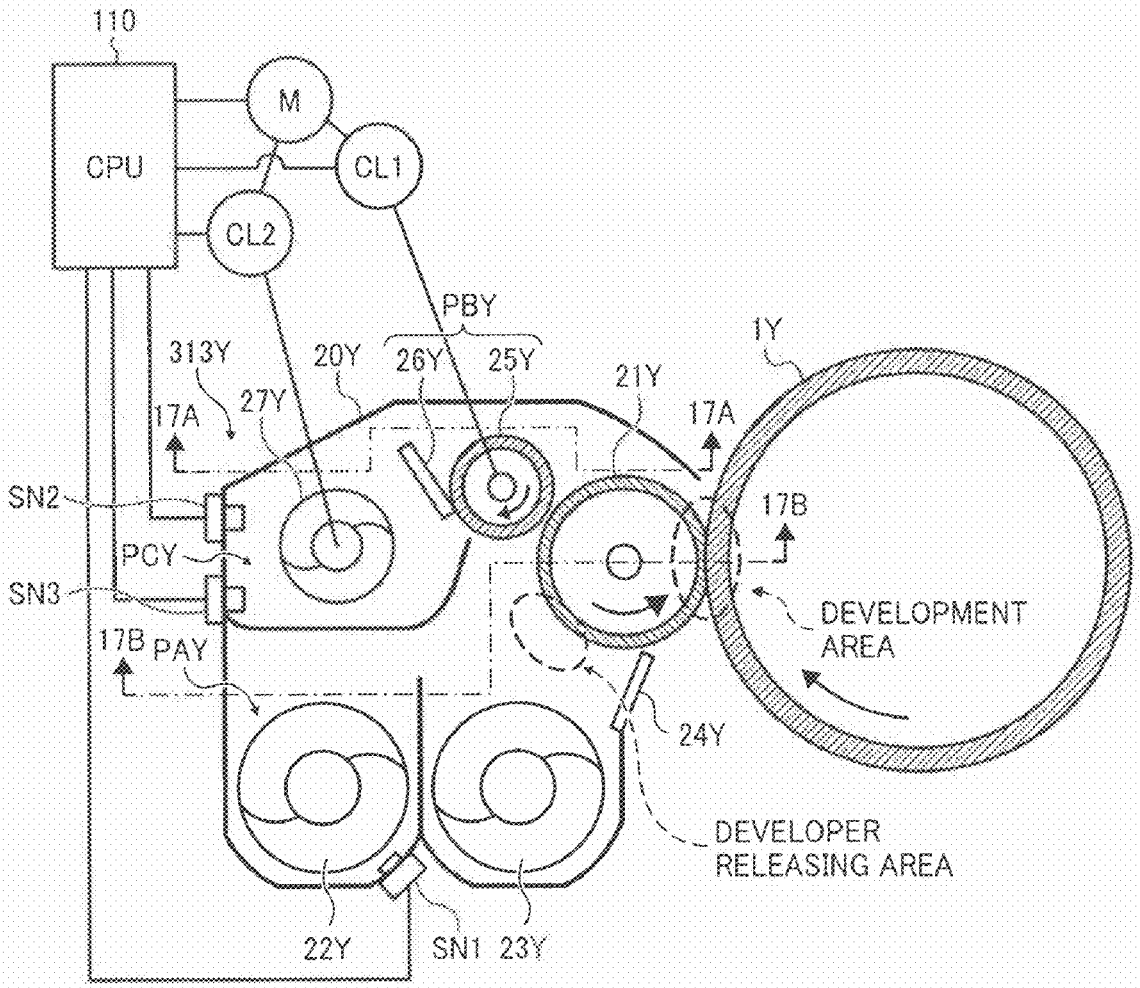
FIG. 16 is a cross-sectional view for explaining a schematic structure of a developing unit according to a fourth exemplary embodiment of the present invention.

Next, descriptions are given of a toner cartridge 5*a* attached to the color printer 100 and new toner supplying operations performed by the color printer 100 in reference to FIGS. 15 and 16.

FIG. 15 is a plan view of a schematic structure of the toner cartridge 5*a* according to an exemplary embodiment of the present invention, FIG. 16 is a cross sectional view of the developing unit 313Y. As previously described, the toner cartridge 5*a* accommodates yellow toner. Since the toner cartridges 5*a*, 5*b*, 5*c*, and 5*d* have similar configurations to each other, except the color of toner, it should be understood that the following description also corresponds to the toner cartridges 5*b*, 5*c*, and 5*d*.

The toner cartridge 5*a* accommodates new or fresh yellow toner, and includes a cartridge body 50*a*, a cap 51*a*, a cartridge gear 52*a*, and a cap opening 53*a*.

The cartridge body 50*a* includes a spiral-shaped toner conveyance groove on an inner wall thereof. The cartridge gear 52*a* is integrally mounted on the cartridge body 50*a* and protrudes from a slit formed on a part of the cap 51*a*, so that the cartridge gear 52*a* rotates by receiving a drive transmission from the main body of the color printer 100.

The cap 51*a* blocks an opening at one end of the cartridge body 50*a* and rotatably supports the cartridge body 50*a*. The cap 51*a* includes a cap opening 53*a*, which is indicated by a dashed line and includes a shutter mechanism, not shown, so that new yellow toner can be discharged out via the cap opening 53*a*.

In the color printer 100, the toner cartridges 5*a*, 5*b*, 5*c*, and 5*d* and the developing units 13Y, 13C, 13M, and 13K are connected via new toner supply paths 9*a*, 9*b*, 9*c*, and 9*d*, respectively, via the cap openings 53*a*, 53*b*, 53*c*, and 53*d*, respectively. The new toner supply paths 9*a*, 9*b*, 9*c*, and 9*d* are shown with dashed lines in FIG. 15. According to the above-described configuration, new toners of respective colors filled in the toner cartridges 5*a*, 5*b*, 5*c*, and 5*d* can be supplied to the developing units 13Y, 13C, 13M, and 13K, respectively, via the new toner supply paths 9*a*, 9*b*, 9*c*, and 9*d*, respectively.

The new toner supply paths 9*a*, 9*b*, 9*c*, and 9*d* are connected to the control unit 110 shown in FIG. 16, which controls an ON/OFF time per given time of each of the new toner supply paths 9*a*, 9*b*, 9*c*, and 9*d*.

Each of the new toner supply paths 9*a*, 9*b*, 9*c*, and 9*d* includes a supplying screw 90*a*, which serves as a new toner conveyance member that can control an amount of supply of new toner, and a residual toner sensor, not shown, which detects whether toner remains in the toner supply path. When the toner density sensor SN1 provided in the developing unit 313Y, which can also corresponds to any of developing units 313C, 313M, and 313K, detects that the toner density in the developing unit 313Y is low (see FIG. 16), the control unit 110 rotates the cartridge body 50*a* of the toner cartridge 5*a* and the supplying screw 90*a* to supply a given amount of toner to the developing unit 13 via the new toner supply path 9, which can be any of the new toner supply paths 9*a*, 9*b*, 9*c*, and 9*d*.

Further, when detecting no toner or toner-empty that indicates there is no toner left in the new toner supply path 9, the residual toner sensor of the color printer 100 may send a request to the corresponding toner cartridge 5, which corresponds any of the toner cartridges 5*a*, 5*b*, 5*c*, and 5*d*, to supply toner therefrom. If the residual toner sensor does not detect any toner in the new toner supply path 9 even after a given period of time, it is determined that there is no toner left in the toner cartridge 5.

Detailed descriptions are given of the developing unit 313Y, which has a substantially same structure and functions as the developing units 313Y, 313C, 313M, and 313K incorporated in the color printer 100, according to Exemplary Embodiment 4 of the present invention.

Figure 17A:
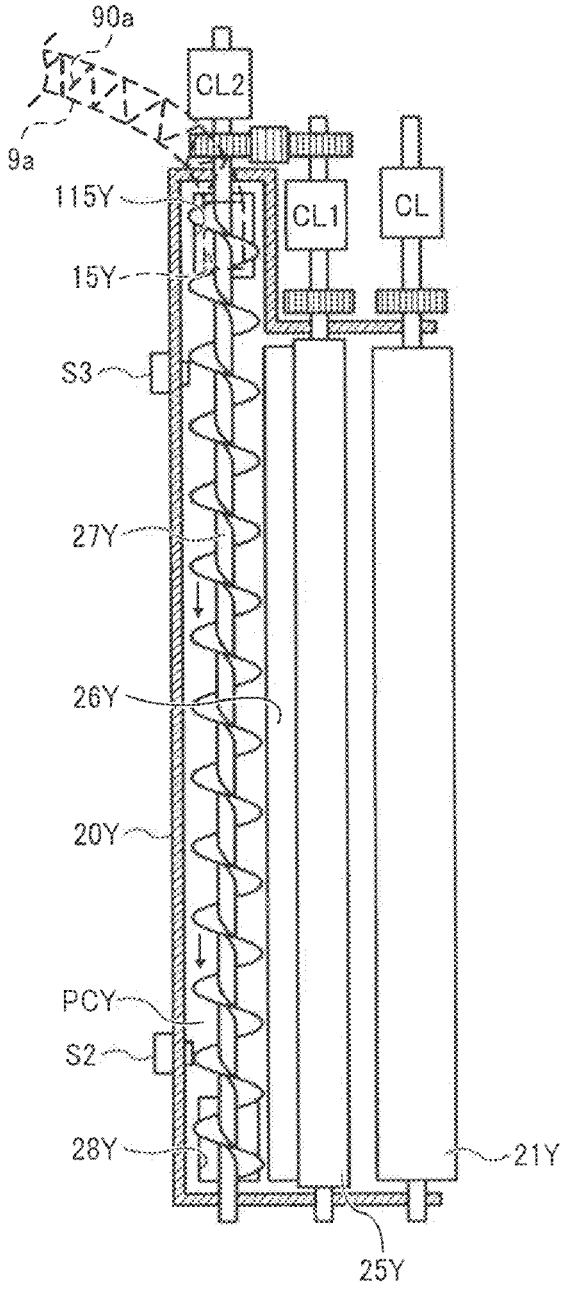
FIG. 17A is a cross-sectional top view of a schematic structure of the developing unit taken along line 17A-17A of FIG. 16.
Figure 17B:
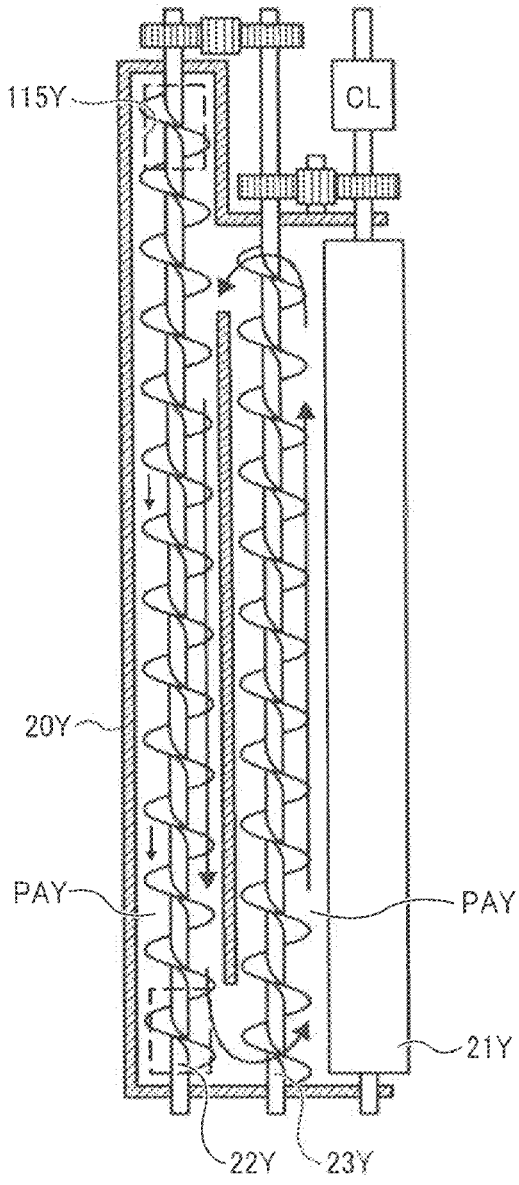
FIG. 17B is a cross-sectional top view of a schematic structure of the developing unit taken along line 17B-17B of FIG. 16.

FIG. 16 is a vertical cross-sectional view for explaining a schematic structure of the developing unit 313Y according to Exemplary Embodiment 4. FIGS. 17A and 17B are cross-sectional top views of a schematic structure of the developing unit 313Y. FIG. 17A is a cross-sectional view taken along line 17A-17A of FIG. 16, and FIG. 17B is a cross-sectional view taken along line 17B-17B of FIG. 16.

As described in Exemplary Embodiment 1, since the four developing units 13Y, 13C, 13M, and 13K have similar structures and functions, except that respective toners are of different colors, which are yellow, cyan, magenta and black toners, the discussion below will be focused on the developing unit 313Y and the image forming components incorporated therein.

Further, as described above, the elements or components of the developing unit 313Y are similar in structure and functions to the elements or components of the developing unit 13Y in Exemplary Embodiment 1. Therefore, the following descriptions mainly show the elements or components of the developing unit 313Y that are different from the developing unit 13Y.

The developing unit 313Y is a dual-axis type developing unit using a two-component dry developer, and includes the developer case 20Y that includes the developing roller 21Y disposed along and parallel to an axis of the photoconductor drum 1Y, with a given optimum gap therebetween (approximately 0.2 mm to 0.4 mm in Exemplary Embodiment 4).

In this exemplary embodiment, the developing roller 21 has an outer diameter of 18 mm, a length of roller of 326 mm (a range the developer is carried is 303 mm), and a speed of rotation is 315 rpm. The agitating screws 22Y and 23Y has a pitch of 20 mm, a diameter of a screw blade of 14 mm (a shaft diameter of 6 mm), a length or range of screw movement of 330 mm, and a speed of rotation of 350 rpm.

The doctor blade 24Y included in the developer case 20Y is made of aluminum and serves as a regulating member to regulate a thickness of developer carried on the surface of the developing roller 21Y.

As shown in FIG. 17A, the developing unit 313Y includes a fall-type outlet port 115Y that is disposed on a bottle surface at a most upstream side in a direction of conveyance of developer and below the new toner inlet 15Y. The fall-type outlet port 115Y is arranged in communication with the developer supply path PAY and the collected toner conveyance path PCY. The new toner conveyed through the new toner supply path 9*a* is supplied via the fall-type outlet port 115Y to the developer supply path PAY.

Toner collection by the toner collecting mechanism PBY in the developing unit 313Y is controlled according to instructions from the CPU, which is the control unit 110 of the main body of the color printer 100. According to the instructions issued by the control unit 110, rotations of the toner collection roller 25Y is controlled by turning on and off a solenoid-type clutch CL1 that is disposed in a line of drive gears of the toner collection roller 25Y to transmit or disconnect a drive force from a motor M serving as a drive unit to the toner collection roller 25Y.

The toner collection roller 25Y of the developing unit 313Y is disposed in the vicinity of the developing roller 21Y including the magnet roller and contacts magnetic carrier particles carried on the developing roller 21Y. The toner collection roller 25Y is preferably formed by non-magnetic material such as an aluminum tube or a non-magnetic stainless roller so as to prevent collection of carrier particles affected by magnetic flux density of the developing roller 21Y and attract toner particles electrostatically. Further, it is preferable that a positional interval of the toner collection roller 25Y and the developing roller 21Y is substantially equal to a positional interval of the developing roller 21Y and the photoconductor drum 1Y (for example, 0.2 mm to 0.4 mm in Exemplary Embodiment 4). The toner collection roller 25Y in this exemplary embodiment has a diameter of 16 mm and a length of roller of 336 mm, and is formed by an aluminum hollow tube, a rotary shaft pressed to fit at both ends thereof and rotatably supported by the developer case 20 to be rotatable at a speed of 100 rpm.

In this exemplary embodiment, the collection blade 26Y is formed by polyurethane rubber with a thickness of 1.8 mm, a protrusion part length of 7.6 mm, and a contact pressure of 0.2 N/cm.

Toner collection can be controlled by a contact and separation operation performed by the collection blade 26Y instead of the above-described rotation control of the toner collection roller 25Y. A mechanism performing the contact and separation operation or a contact and separation mechanism include a general configuration in which a spring constantly pressing the collection blade 26Y to a direction of contact and a cam clutch is used to separate the collection blade 26Y from the toner collection roller 25Y. By employing such a contact and separation operation to control the toner collection, the contact and separation mechanism enables toner collection when the collection blade 26Y contacts the toner collection roller 25Y, and toner adhering to the toner collection roller 25Y rotates but the toner is not collected when the collection blade 26Y is separate from the toner collection roller 25Y. Further, since the contact and separation mechanism separates the collection blade 26Y against the pressure of the spring when collecting toner, it is necessary to provide a clutch having a rather greater power than the above-described mechanism using roller. However, when stopping, the collection blade 26Y is left separated from the toner collection roller 25Y, and therefore it can be expected to achieve effects such as prevention of fixing of the toner collection roller 25Y and the collection blade 26Y and prevention of sag or poor resilience caused by a long contact of the collection blade 26Y.

The collected toner conveyance screw 27Y of the developing unit 313Y serves as a collected toner conveying member and is rotated by a drive unit or a motor M to convey the collected toner by the toner collecting mechanism PBY in a direction as indicated by arrows in FIG. 17A.

The collected toner conveyance screw 27Y is connected to the motor M via a solenoid-type clutch CL2 and a line of gears, and controls an amount of rotation by controlling the ON/OFF time per a unit and control an amount of conveyance or supply of collected toner collected by the toner collecting mechanism PBY. In this exemplary embodiment, the collected toner conveyance screw 27Y has a pitch of screw of 15 mm, a diameter of screw blade of 10 mm (a shaft diameter of 3 mm), a length or range of screw movement of 300 mm, and a speed of rotation of 100 rpm ($min^{-1}$), which are fixed to the values so as to adjust the ON/OFF time of the clutch CL2 to control the amount of supply of developer. As shown in FIGS. 17A and 17B, a clutch CL is disposed in a line of drive gears of the developing roller 21Y.

The collected toner conveyance path PCY includes a toner-full sensor SN2 and a toner-empty sensor SN3. The toner-full sensor SN2 is a piezoelectric type sensor to detect a state that the collected toner conveyance path PCY is full of the collected toner. The toner-empty sensor SN3 is also a piezoelectric type sensor to detect a state that the collected toner conveyance path PCY is without the collected toner or contains no collected toner. The toner-full sensor SN2 and the toner-empty sensor SN3 are electrically connected to the CPU of the main body of the image forming apparatus so that the toner-full sensor SN2 and the toner-empty sensor SN3 detect whether the collected toner conveyance path PCY is full or empty with the collected toner and then the CPU determines the state.

The toner-full sensor SN2 is disposed in the vicinity of the communication opening 28Y at a downstream side in a direction of conveyance of collected toner by the collected toner conveyance screw 27Y and opposed to an upper portion from an axial center of the collected toner conveyance screw 27Y, as shown in FIG. 17A. The toner-full sensor SN2 is disposed at the position because a volume of accumulation of the collected toner becomes cumulatively highest at the downstream side in the direction of conveyance of collected toner by the collected toner conveyance screw 27Y, which is an optimal position to detect the full state of the collected toner.

The toner-empty sensor SN3 is disposed in the vicinity of the communication opening 28Y at an upstream side in the direction of conveyance of collected toner by the collected toner conveyance screw 27Y and opposed to a lower portion from the axial center of the collected toner conveyance screw 27Y, as shown in FIG. 17A. The toner-empty sensor SN3 is disposed at the position because a volume of accumulation of the collected toner becomes cumulatively lowest at the upstream side in the direction of conveyance of collected toner by the collected toner conveyance screw 27Y, which is an optimal position to detect the empty state of the collected toner.

The toner-full sensor SN2 and toner-empty sensor SN3 are not limited to be piezoelectric but can be an optical-type sensor. The optical sensor includes elements to constantly emit or receive light therein so as to detect the existence of toner depending on changes of a conduction state to the optical sensor. The toner full or toner-empty states are determined according to a conveyance operation performed by the collected toner conveyance screw 27Y, with some allowance by expecting factor of safety based on the results of a continuous image forming test in a possible average image area, etc.

As an example, the continuous image forming test examined the states of toner by printing 1,000 A4-size sheets of an image with the image area ratio of 5%, and printing 1,000 A4-size sheets of images with the image area ratios of 50%, 10%, and 3% mixed with a given ratio. The toner-full sensor SN2 is disposed in the vicinity of an upper end portion on an outer circumference of screw blade of the collected toner conveyance screw 27Y to face thereto. The toner-empty sensor SN3 is disposed in the vicinity of a lower end portion on the outer circumference of screw blade of the collected toner conveyance screw 27Y to face thereto. Detailed installation height and sensitivity are adjusted according to the results of the previously described tests, etc.

As described above, the developing unit 313Y includes the collection blade 26Y that contacts its edge to the toner collection roller 25Y to scrape the developer. However, a collection member is not limited to the collection blade 26Y. For example, a brush-type collection member in which a brush roller contacts the toner collection roller 25Y and a flicker cut into the brush roller collects toner from the toner collection roller 25Y, or an electrostatic collection member in which the toner collecting mechanism changes the bias to apply to the toner collection roller 25Y to change an electrostatic attraction force so as to remove and collect toner from the toner collection roller 25Y.

Further, as an example of the new toner conveyance unit and collected toner conveyance unit, a screw-type member that is rotated by a drive unit has bee described. However, a conveyance unit for conveying mixture of air and toner by using a powder pump, such as an uniaxial eccentric screw pump disclosed in Japanese Patent Application Publication No. 10-333412 and a diaphragm pump, can also be applied to the present invention. By so doing, a simple and space-saving unit can be achieved.

Next, a description is given of operations performed the developing unit 313Y in reference to FIGS. 16, 17A, and 17B. Since the basic operations of the developing unit 313Y are similar to those of the developing unit 13Y, the following description shows different actions only.

New toner supplied from the new toner inlet 15Y of the developer case 20Y and the fall-type outlet port 115Y of the collected toner conveyance path PCY is charged while being mixed by the agitating screws 22Y and 23Y with the magnetic carrier accommodated in the developer case 20Y and conveyed in a direction indicated by the arrows in FIG. 17B toward the developing roller 21Y.

When toner that was not used in the development and carrier that conveyed the toner are conveyed to a position opposed to the toner collection roller 25Y, a given voltage is applied to the toner collection roller 25Y at a given timing so that only the toner is electrostatically attracted from the developer carried on the developing roller 21Y to the toner collection roller 25Y. Toner and carrier not collected by the toner collection roller 25Y and still remaining on the developing roller 21Y are conveyed to the developer releasing area shown in FIG. 16, which is the area before the developer agitating screws Y22 and Y23 according to further rotation of the developing roller 21Y.

The collected toner particles conveyed to the collected toner conveyance path PCY can be returned by the collected toner conveyance screw 27Y to the developer supply path PAY via the communication opening 28Y.

As described above, the control unit 110 controls the bias applied to the toner collection roller 25Y so as to control the amount of toner collected by the toner collection roller 25Y that serves as a toner collecting mechanism.

[Controls of Toner Collection, Collected Toner Supply, and New Toner Supply]

Figure 18:
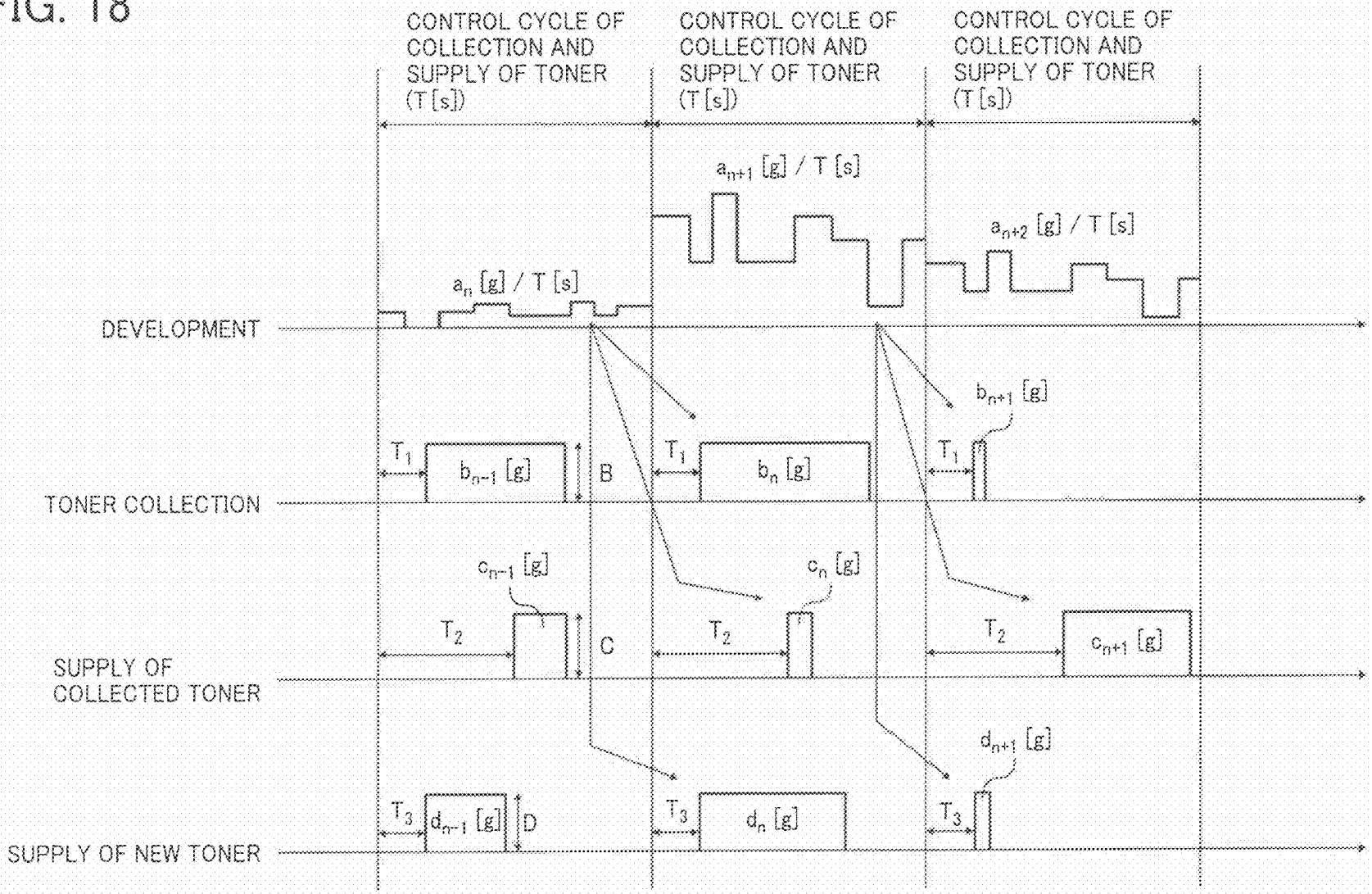
FIG. 18 is a drawing showing flows of controls of an amount of consumed toner, an amount of collected toner, an amount of supply of collected toner, and an amount of supply of new toner of the developing unit of FIG. 16.
Figure 19:
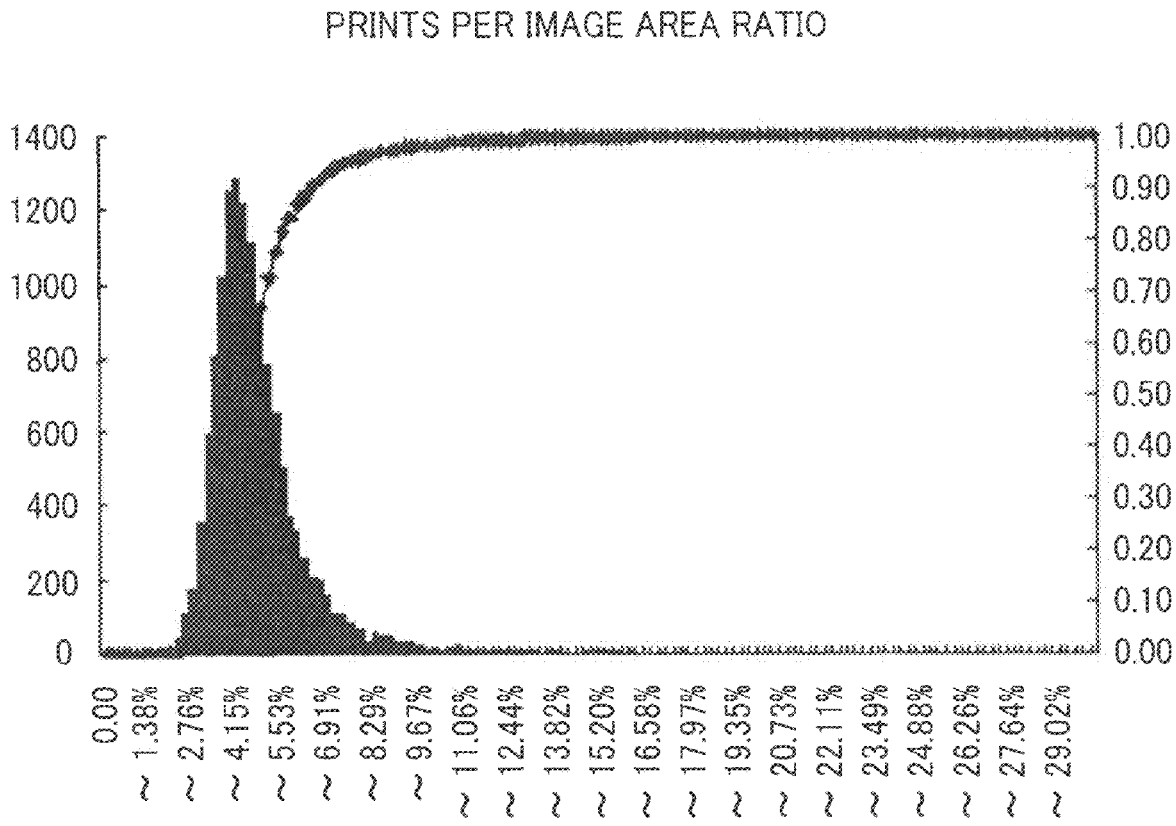
FIG. 19 is a graph showing statistical results of print volume per image area ratio.
Figure 20:
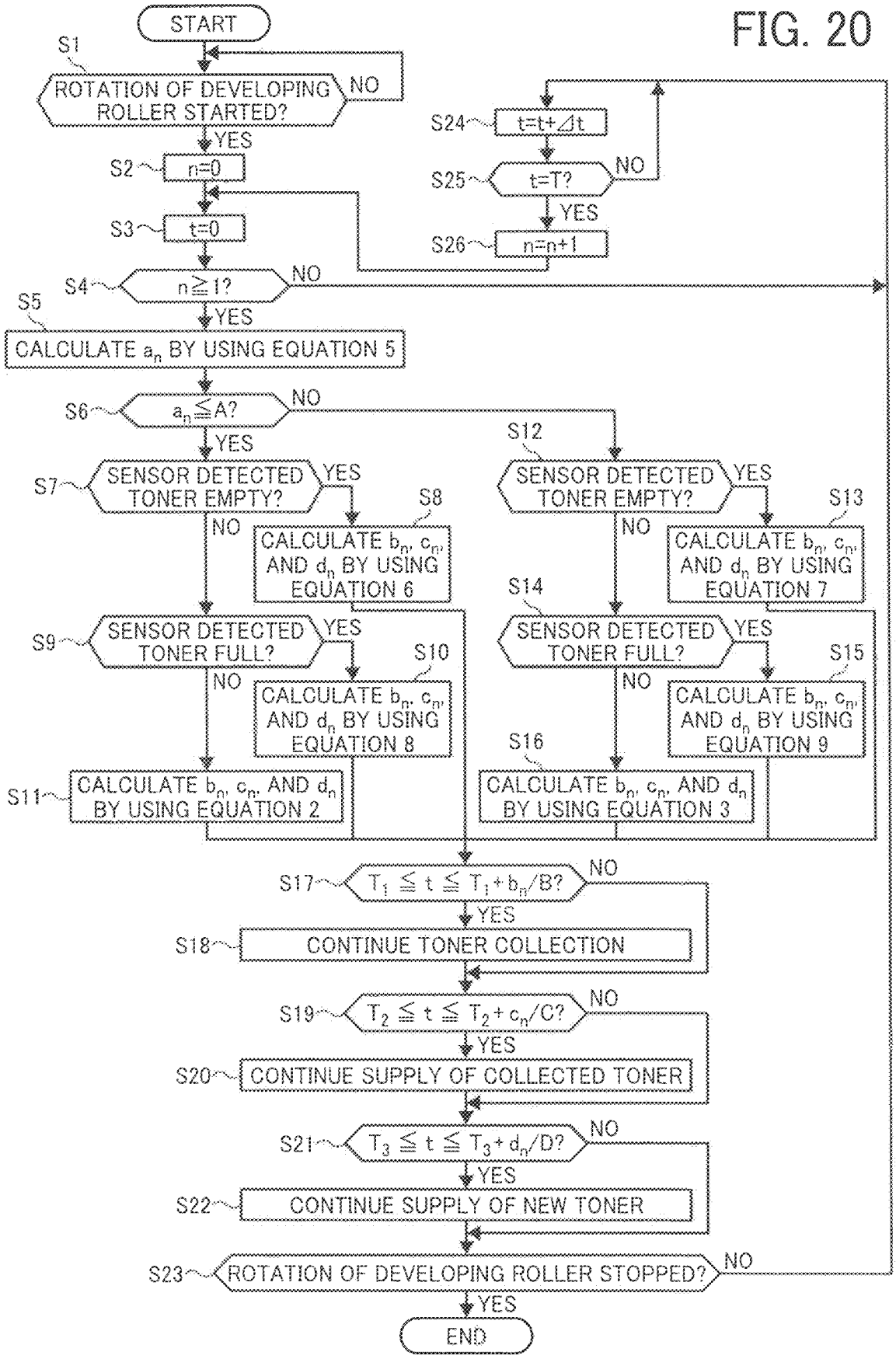
FIG. 20 is a flowchart showing the flows of controls of the amounts of FIG. 18.

Next, referring to FIGS. 18 to 20, controls of toner collection, supply of collected toner, and supply of new toner in the image forming apparatus or the color printer 100 according to an exemplary embodiment of the present invention are described in detail.

FIG. 18 is a drawing showing flows of controls of an amount of consumed toner, an amount of collected toner, an amount of supply of collected toner, and an amount of supply of new toner. FIG. 19 is a graph showing statistical results of print volume per image area ratio. FIG. 20 is a flowchart showing the flows of controls of FIG. 18.

In the color printer 100 that serves as an image forming apparatus according to an exemplary embodiment of the present invention, the control unit 110 controls in cycles of a unit time T [seconds] as shown in FIG. 18. First, the control unit 110 calculates an amount of consumed toner $a_n$ [gram], which is an integration value of consumed toner obtained at a point in the n-th cycle of the unit time T, and compares the amount of consumed toner $a_n$ and a reference value A to determine whether the amount of consumed toner an is greater or smaller than the reference value A. According to the result of determination, the control unit 110 determines and controls an amount of collected toner $b_n$ [gram] per unit of time T, an amount of supply of collected toner $c_n$ [gram] per unit of time T, and an amount of supply of new toner $d_n$ [gram] per unit of time T according to the following descriptions.

It is assumed that the reference value A is an average amount of consumed toner that is consumed due to development during the unit time T. That is, the reference value A corresponds to a value of an average image output by the color printer 100 and is used to determine whether the image has a high image area ratio or a low image area ratio so that the control unit 110 can adjust control methods or procedures.

[Normal Amount of Collected Toner]

A description is given of control procedures when the amount of collected toner is normal. "Normal" means, in the present invention, a boundary of accumulated collected toner is between a toner full level of the toner-full sensor SN2 of FIG. 16 and a toner empty level of the toner-empty sensor SN3 of FIG. 16. Specifically it means that the collected toner in the developer case 20Y is neither full nor empty. From a view of transition of image forming, it is contemplated that images with a high image area ratio and images with a low image area ratio are evenly developed, for example.

Amount of collected toner $b_n=A-a_n+\alpha$, [Mathematical Expression 1]

Amount of supply of collected toner $c_n=\alpha$, and

Amount of supply of new toner $d_n=A$ Equation 2.

Case 1: $a_n \leqq A$ (a case when the amount of consumed toner in development is small or when the image area ratio is low).

Case 1 shows that, for example, the trend of image forming has transited from a state that both images with a high image area ratio and images with a low image area ratio are evenly developed to a state that images with a low image area ratio are more developed. The symbol "α" represents any set value of 0 or above according to a volume of capacity of the collected toner conveyance path. In this exemplary embodiment, the value a is set to 0, satisfying "α=0." The condition under "α=0" is a state in which, while the toner collection roller 25 rotates to continuously collect toner to the collected toner conveyance path, the collected toner conveyance screw is stopped and therefore the supply of the collected toner from the communication opening is stopped.

The value a is set to 0 because of the following reasons. In a case in which images with a low image area ratio are printed continuously, if toner collection and supply of collected toner from the communication opening are continued, it is highly likely that the collected toner circulates repeatedly in the developer supply path, resulting in promotion of toner deterioration. Therefore, to prevent the problem, it is intended that the toner that has passed the development nip or development area once is collected as soon as possible and, when an image with a low image area ratio is developed, only new toner is used.

However, when the volume of capacity of the collected toner conveyance path is relatively small, if the value a is set to 0, toner collection is accelerated to cause the amount of collected toner to be detected as "full" shortly. As a result, it can be expected that the control unit 110 controls the amounts of various toners as described later in a case "when the amount of collected toner is overlarge". In that case, it is only necessary to set the value a as a given value and supply the collected toner intermittently to an acceptable level of toner deterioration due to recirculation.

Amount of collected toner $b_{n=\beta}$, [Mathematical Expression 2]

Amount of supply of collected toner $c_n=a_n-\gamma+\approx$, and

Amount of supply of new toner $d_n=\gamma$ Equation 3.

Case 2: $a_n>A$ (a case when the amount of consumed toner in development is large or when the image area ratio is high).

Case 2 shows that, for example, the trend of image forming has transited from a state that both images with a high image area ratio and images with a low image area ratio are evenly developed to a state that images with a high image area ratio are more developed. The symbols "β" and "γ" represent any set value of 0 or above. In this exemplary embodiment, the value β is set to 0, satisfying "β=0," and the value γ is set to 0, satisfying "γ=0." The condition under "β=0" is a state in which, while the toner collection roller 25 is stopped and therefore toner is not conveyed to the collected toner conveyance path, the collected toner conveyance screw is rotated and therefore the collected toner is supplied to the developer supply path. The condition under "γ=0" is a state in which new toner is not supplied. Therefore, when a relation of "β=γ=0" is satisfied, development is temporarily performed only with the collected toner. In this case, consumption of toner remaining in the collected toner conveyance path is enhanced, thereby preventing an increase in deteriorated toner in advance.

However, when the volume of capacity of the collected toner conveyance path is rather small, it is expected that the relation of "β=γ=0" can quickly lead to depletion of the collected toner. This condition in which only new toner is used for development in a subsequent image forming can be caused by a related-art developing unit. This condition cannot achieve any interaction effect of the present invention, however, the supplied new toner is continuously consumed. Therefore, toner deteriorated by agitation and circulation may not be generated. However, the trend of toner density in the developer supply path may change from a state in which collected toner and new toner are mixed and gradually close to a state in which only new toner is contained, and it is likely that image density or color of the developed image can be changed.

To avoid the above-described state, the value γ, which corresponds to the amount of supply of new toner $d_n$, is set as a given value. By so doing, the depletion of the collected toner in the collected toner conveyance path can be delayed and, at the same time, the trend of toner density in the developer supply path can be maintained in a relatively small rate of change, which can settle the image density of developed images.

Further, a weight sensor, for example, can be provided in the collected toner conveyance path to obtain the amount of collected toner $b_n$ therein. By so doing, the amount of supply of new toner $d_n$ can be changed according to the amount of collected toner $b_n$ in the collected toner conveyance path. In this case, when the amount of collected toner $b_n$ is small, the amount of supply of new toner $d_n$ is set to γ, which is a function of the amount of collected toner $b_n$ (0 or above), so that new toner is supplied regularly supply to the developer. By contrast, when the amount of collected toner $b_n$ is large, the value γ is set to 0 so as to prevent an excess of toner in the collected toner conveyance path. This can achieve a same effect as described above, that is, to reduce the rate of change of toner density in the developer supply path and settle the image density or color of developed images.

[Reference Value A]

This reference value A is assumed to be an average amount of toner consumed in development during the unit time T. However, the amount of consumed toner may vary largely depending on an image area ratio of an image to be output, and the image area ratio may vary depending on user's purpose of use. For example, a high-speed machine tends to output images with a relatively high image area ratio.

The inventors of the present invention therefore examined statistics of image areas to be printed. As previously described, FIG. 19 is a graph showing statistical results of print volume per image area ratio. As can be seen from the graph of FIG. 19, the image area ratio reached the peak in the vicinity of 3% to 6%. Assuming that the peak of the image area ratio ranges from 2% to 7% with some tolerance, the amount of consumed toner per unit of time T when an image with an image area ratio of y % can satisfy a relation of "y/100·x·T/t." Accordingly, the following Equation 4 can be obtained:

$$0.02 \cdot x \cdot T/t \leqq A \leqq 0.07 \cdot x \cdot T/t \qquad \text{Equation 4,}$$

where "x" represents an amount of consumed toner [gram] when one solid image is output, "T" represents a unit of time [seconds] corresponding to a reference period of time in which the control unit controls at least one of toner collection and supply of collected toner, and "t" represents a time [seconds] required for printing one image in continuous image printing.

In this exemplary embodiment, a test is conducted with a copier that can print 30 copies of A4-size, landscape image per minute and provide 0.45 mg/cm$^2$ of an amount of toner adhesion per unit area when printing a solid image. The control time T corresponds to a period of time to output 10 sheets of image, and the reference value A was determined where "t" is 2 [seconds], "x" is 0.45·20·29=0.26 [gram] "T" is 20 [seconds], and "y" is 5%, and therefore, A is 0.05·0.26·20/2=0.13 [gram].

[Amount of Consumed Toner $a_n$]

This time the amount of consumed toner $a_n$ was detected based on an image area ratio. The image area ratio can be calculated from a density of a pixel that corresponds to the number of pixels of an image input to the CPU to be formed or a desired image density. These characteristics for calculating image area ratios can be replaced to corresponding parameters. Specifically, the number of pixels can be replaced to the number of light emitting points from the optical writing unit 2 and the image density can be replaced to the intensity and period of time of light per light emitting point, respectively. By so doing, images can be controlled in development. Alternatively, the amount of consumed toner $a_n$ can be calculated by using the integrated value based on the number of pixels and density of the preceding or adjacent image according to image data including the given number of sheets printed in the immediately preceding job. In this exemplary embodiment, the image density was used to obtain the amount of consumed toner an with the following Equation 5:

$$\text{Amount of consumed toner } a_n = (\text{Sum of image area ratios of images output during the unit time } T) \cdot x/20 \qquad \text{Equation 5.}$$

Instead of using Equation 5, the amount of consumed toner $a_n$ can be obtained by using a toner density sensor to detect the toner density.

[Small Amount of Collected Toner]

Next, a description is given of control procedures when the amount of collected toner in the collected toner conveyance path is small.

The state in which "the amount of collected toner in the collected toner conveyance path is small" means that the toner-empty sensor has detected a toner empty condition in the collected toner conveyance path. In this case, instability of the subsequent procedure of the control, which is the amount of supply of collected toner $c_n$, is controlled with the following Equation 6.

$$\text{Amount of collected toner } b_n = A - a_n + \alpha, \qquad \text{[Mathematical Expression 3]}$$

$$\text{Amount of supply of collected toner } c_n = 0, \text{ and}$$

$$\text{Amount of supply of new toner } d_n = A + \alpha \qquad \text{Equation 6.}$$

Case 3: $a_n \leqq A$ (a case when the amount of consumed toner in development is small or when the image area ratio is low).

Case 3 shows, for example, a transitional state after continuous development of images with a high image ratio. That is, since images with a high image area ratio were continuously developed in the immediately preceding job, the amount of collected toner decreased, and therefore collected toner in the collected toner conveyance path became empty. However, further images to be developed in a subsequent job will be with a low image area ratio. As previously described, the value a can be any set value of 0 or above according to a volume of capacity of the collected toner conveyance path. For consistency with the case of the normal amount of collected toner, the value α is set to 0, satisfying "α=0." The condition under "α=0" is a state in which the toner collecting mechanism is controlled to operate intermittently so as to collect toner of the amount of consumed toner $b_n$ that is obtained by subtracting the amount of consumed toner an calculated based on the image area ratio from the average amount of consumed toner A. Further, the collected toner conveyance screw is stopped and therefore the amount of supply of collected toner $c_n$ is 0. Further, the supply of new toner is controlled to supply toner of the average amount of consumed toner A. By so doing, the amount of collected toner is recovered and the supply of new toner continues until the toner empty state is released.

$$\text{Amount of collected toner } b_n = \beta, \qquad \text{[Mathematical Expression 4]}$$

$$\text{Amount of supply of collected toner } c_n = 0, \text{ and}$$

$$\text{Amount of supply of new toner } d_n = a_n + \beta \qquad \text{Equation 7.}$$

Case 4: $a_n > A$ (a case when the amount of consumed toner in development is large or when the image area ratio is high).

Case 4 shows, for example, a transitional state after continuous development of images with a high image ratio. That is, since images with a high image area ratio were continuously developed in the immediately preceding job, the amount of collected toner decreased, and therefore collected toner in the collected toner conveyance path became empty. In addition, further images with a high image area ratio will be developed in a subsequent job. As previously described, the value β can be any set value of 0 or above. For consistency with the case of the normal amount of collected toner, the value β is set to 0, satisfying "β=0." In this case, image forming is performed with new toner alone, which is substantially same as a conventional developing unit of dual-axis type. Since the supplied new toner is consumed rapidly, it is less likely to generate deteriorated toner. It is only necessary to transit to Case 3 to recover toner collection performed by the toner collecting mechanism at the change of density in the image forming operation from high density to low density.

[Overlarge Amount of Collected Toner]

Next, a description is given of control procedures when the amount of collected toner in the collected toner conveyance path is too large.

The state in which "the amount of collected toner in the collected toner conveyance path is overlarge" means that the toner-full sensor has detected a toner full condition in the collected toner conveyance path. In this case, it is likely that inconveniences such as an increase in drive load to the collected toner conveyance screw and toner scattering due to overflow of collected toner are generated, and therefore the amount of supply of collected toner $c_n$, is controlled with the following Equation 8.

Amount of collected toner $b_n=A-a_n+\alpha$, [Mathematical Expression 5]

Amount of supply of collected toner $c_n=A+\alpha$, and

Amount of supply of new toner $d_n=0$ Equation 8.

Case 5: $a_n \leqq A$ (a case when the amount of consumed toner in development is small or when the image area ratio is low).

Case 5 shows, for example, a state after continuous development of images with a low image ratio. That is, since images with a low image area ratio were continuously developed in the immediately preceding job, the amount of collected toner in the collected toner conveyance path increased to be full. In addition, further images to be developed continuously in a subsequent job will be with a low image area ratio. As previously described, the value $\alpha$ can be any set value of 0 or above. When the value $\alpha$ is 0, the toner collecting mechanism is controlled to operate intermittently so as to collect toner of the amount of consumed toner $b_n$ that is obtained by subtracting the amount of consumed toner $a_n$ calculated based on the image area ratio from the average amount of consumed toner A. Further, the collected toner conveyance screw is also controlled to operate intermittently so as to supply the average amount of consumed toner A. New toner, however, is not supplied. With the above-described operations, the toner only contained in the developing unit 13 is consumed, and at the same time, toner in the collected toner conveyance path and the toner in the developer supply path can be replaced sequentially. As a result, the load of deterioration to the collected toner can be distributed and the collected toner can be preferentially consumed.

Amount of collected toner $b_n=\beta$, [Mathematical Expression 6]

Amount of supply of collected toner $c_n=a_n+\beta$, and

Amount of supply of new toner $d_n=0$ Equation 9.

Case 6: $a_n>A$ (a case when the amount of consumed toner in development is large or when the image area ratio is high).

Case 6 shows, for example, a transitional state after continuous development of images with a low image ratio. That is, since images with a low image area ratio were continuously developed in the immediately preceding job, the amount of collected toner in the collected toner conveyance path increased to be full. However, further images to be developed in a subsequent job will be with a high image area ratio. As previously described, the value $\beta$ can be any set value of 0 or above. For consistency with the case of the normal amount of collected toner, the value $\beta$ is set to 0, satisfying "$\beta=0$." In this case, the toner collecting mechanism and the new toner supplying screw stopped their operations, and therefore neither toner collection nor supply of new toner was not conducted. By contrast, the collected toner conveyance screw is controlled to operate intermittently so as to supply toner by the amount of consumed toner $a_n$ obtained based on the image area ratio. By so doing, the trend of image forming is changed to promote toner consumption, which triggered preferential discharge of collected toner in the collected toner conveyance path to consume the collected toner before deterioration and the toner full condition is released to recover to the normal condition.

[Control Flow]

The flowchart of FIG. 20 shows the flows of controls of the control unit 110.

Symbol "$T_1$" represents a time difference between the end of calculation of the amount of consumed toner $a_n$ and the start of toner collection, symbol "$T_2$" represents a time difference between the end of calculation of the amount of consumed toner $a_n$ and the start of supply of collected toner, and symbol "$T_3$" represents a time difference between the end of calculation of the amount of consumed toner $a_n$ and the start of supply of new toner. Symbol "B" represents an amount of toner collection per unit of time that corresponds to a speed of toner collection, symbol "C" represents an amount of supply of collected toner per unit of time that corresponds to a speed of supply of collected toner, and symbol "D" represents an amount of supply of new toner per unit of time that corresponds to a speed of supply of new toner. In this exemplary embodiment, the above-described speeds of "B", "C", and "D" are fixed to be 0.1 g/s, satisfying a relation: B=C=D=0.1 g/s.

To fixedly set the speed of toner collection "B" to 0.1 g/s, by referring to the graph of FIG. 5, the voltage calculated using the calculation of the developing bias minus the applied bias of the toner collection roller is set to −300V (+100V while toner collection is not performed) so that the amount of collected toner is controlled by adjusting the ON/OFF time of the applied bias.

Further, to fixedly set the speed of supply of collected toner "C" to 0.1 g/s, the number of rotation of the collected toner conveyance screw is set to 100 rpm so that the amount of supply of collected toner is controlled by adjusting the ON/OFF time of the drive unit of the collected toner conveyance screw. The speed of supply of new toner "D" is set to 0.1 g/s with a same procedure as the above-described speed of supply of collected toner "C".

Details of the control procedures are described below.

First, the control unit 110 confirms whether the developing roller 21 is rotated in step S1. When the developing roller 21 is not rotated, the process is repeated until the start of rotation of the developing roller 21. When the developing roller 21 is rotated, the control unit 110 confirms that the number of control operations, which is represented by "n", is 0 or "n=0" is satisfied in step S2, and that the time required for printing one image in continuous image printing, which is represented by "t", is 0 or "t=0" is satisfied in step S3.

After step S3, the control unit 110 then determines whether the number of control operations "n" has become 1 or greater in step S4. When the number of control operations "n" is not 1, the process goes to step 24, which will be described later. When the number of control operations "n" has become 1 or greater, the control unit 110 calculates the amount of consumed toner $a_n$ by using Equation 5 in step S5, and the process proceeds to step S6.

In step S6, the control unit 110 determines whether the calculated amount of consumed toner $a_n$ is equal to or smaller than the reference A corresponding to an average amount of consumed toner within a range of Equation 4.

When the calculated amount of consumed toner $a_n$ is greater than the reference A, the process goes to step S12, which will be described later.

When the calculated amount of consumed toner $a_n$ is equal to or smaller than the reference A, the control unit 110 determines whether the toner-empty sensor detects that toner in the collected toner conveyance path is empty or not in step S7.

When the toner-empty sensor detects that the toner in the collected toner conveyance path is empty, the control unit 110 calculates the amount of collected toner $b_n$, the amount of supply of collected toner $c_n$, and the amount of supply of new toner $d_n$ by using Equation 6 in step S8, and the process proceeds to step S17, which will be described later.

When the toner-empty sensor detects that the toner in the collected toner conveyance path is not empty, the control unit 110 determines whether the toner-full sensor detects that the toner in the collected toner conveyance path is full or not in step S9.

When the toner-full sensor detects that the toner in the collected toner conveyance path is full, the control unit 110 calculates the amount of collected toner $b_n$, the amount of supply of collected toner $c_n$, and the amount of supply of new toner $d_n$ by using Equation 8 in step S10, and the process proceeds to step S17.

When the toner-full sensor detects that the toner in the collected toner conveyance path is not full, the control unit 110 calculates the amount of collected toner $b_n$, the amount of supply of collected toner $c_n$, and the amount of supply of new toner $d_n$ by using Equation 2 in step S11, and the process proceeds to step S17.

As described above, when the calculated amount of consumed toner $a_n$ is greater than the reference A in step S6, the process goes to step S12. In step S12, the control unit 110 determines whether the toner-empty sensor detects that toner in the collected toner conveyance path is empty or not.

When the toner-empty sensor detects that the toner in the collected toner conveyance path is empty, the control unit 110 calculates the amount of collected toner $b_n$, the amount of supply of collected toner $c_n$, and the amount of supply of new toner $d_n$ by using Equation 7 in step S13, and the process proceeds to step S17.

When the toner-empty sensor detects that the toner in the collected toner conveyance path is not empty, the control unit 110 determines whether the toner-full sensor detects that the toner in the collected toner conveyance path is full or not in step S14.

When the toner-full sensor detects that the toner in the collected toner conveyance path is full, the control unit 110 calculates the amount of collected toner $b_n$, the amount of supply of collected toner $c_n$, and the amount of supply of new toner $d_n$ by using Equation 9 in step S15, and the process proceeds to step S17.

When the toner-full sensor detects that the toner in the collected toner conveyance path is not full, the control unit 110 calculates the amount of collected toner $b_n$, the amount of supply of collected toner $c_n$, and the amount of supply of new toner $d_n$ by using Equation 3 in step S16, and the process proceeds to step S17.

Thus, after the amount of collected toner $b_n$, the amount of supply of collected toner $c_n$, and the amount of supply of new toner $d_n$ are calculated, the process proceeds to step S17 and after to perform operations of the toner collection, the supply of collected toner, and the supply of new toner.

In step S17, the control unit 110 controls the toner collection. As previously described, the amount of toner collection per unit of time "B" is fixed in this exemplary embodiment of the present invention, and therefore the time to operate the toner collecting mechanism can be calculated as "$b_n$/B" based on the calculated amount of collected toner $b_n$. Therefore, the control unit 110 determines in step S17 whether the time "t" required for printing one image in continuous image printing falls between the given time difference "T1" from the end of calculating the amount of consumed toner $a_n$ until the start of the toner collection and the time "$b_n$/B" or a relation of "$T1 \leqq t \leqq T1+b_n/B$" is satisfied.

When the time "t" falls between the given time difference "T1" and the time "$b_n$/B", the control unit 110 causes the toner collecting mechanism to continue the operation of toner collection in step S18, and the process then proceeds to step S19.

When the time "t" occurs before the time difference "T1" or after the time "$b_n$/B", in other words, when the time "t" is out of range and the relation of "$T1 \leqq t \leqq T1+b_n/B$" is not satisfied, the control unit 110 causes the toner collecting mechanism to stop the operation of toner collection, and proceeds the process to step S19.

In step S19, the control unit 110 controls the operation of supply of collected toner. As previously described, the amount of supply of collected toner per unit of time "C" is fixed in this exemplary embodiment of the present invention, and therefore the time to operate the toner collecting mechanism can be calculated as "$c_n$/C" based on the calculated amount of supply of collected toner $c_n$. Therefore, the control unit 110 determines in step S19 whether the time "t" required for printing one image in continuous image printing falls between a given time difference "T2" from the completion of calculating the amount of consumed toner $a_n$ until the start of the toner collection and the time "$c_n$/C" or a relation of "$T2 \leqq t \leqq T2+c_n/C$" is satisfied.

When the time "t" falls between the given time difference "T2" and the time "$c_n$/C", the control unit 110 causes the toner collecting mechanism to rotate the rotation of the collected toner conveyance screw to continue the operation of supply of collected toner in step S20, and the process then proceeds to step S21.

When the time "t" occurs before the time difference "T2" or after the time "$c_n$/C", in other words, when the time "t" is out of range and the relation of "$T2 \leqq t \leqq T2+c_n/C$" is not satisfied, the control unit 110 causes the toner collecting mechanism to stop rotating the collected toner conveyance screw so as not to supply the collected toner, and proceeds the process to step S21.

In step S21, the control unit 110 controls the operation of supply of new toner. As previously described, the amount of supply of new toner per unit of time "D" is fixed in this exemplary embodiment of the present invention, and therefore the time to operate the toner collecting mechanism can be calculated as "$d_n$/D" based on the calculated amount of supply of mew toner $d_n$. Therefore, the control unit 110 determines in step S21 whether the time "t" required for printing one image in continuous image printing falls between a given time difference "T3" from the completion of calculating the amount of consumed toner $a_n$ until the start of the toner collection and the time "$d_n$/D" or a relation of "$T3 \leqq t \leqq T3+d_n/D$" is satisfied.

When the time "t" falls between the given time difference "T3" and the time "$d_n$/D", the control unit 110 causes the toner collecting mechanism to rotate the rotation of the new toner conveyance screw to continue the operation of supply of new toner in step S22, and the process then proceeds to step S23.

When the time "t" occurs before the time difference "T3" or after the time "$d_n$/D", in other words, when the time "t" is out of range and the relation of "$T3 \leqq t \leqq T3+d_n/D$" is not satisfied, the control unit 110 causes the toner collecting mechanism to stop rotating the new toner conveyance screw so as not to supply the new toner, and proceeds the process to step S23.

In step S23, the control unit 110 determines whether the rotation of the developing roller 21 is stopped. When the developing roller 21 is still rotating, the process goes to step S24.

After confirming that a relation of "t=t+Δt" is satisfied in step S24, the control unit 110 determines whether the time "t" reaches a subsequent control time "T" in step S25.

When the time "t" has not yet reached a subsequent control time "T", the process goes back to step S24 to repeat until the time "t" reaches a subsequent control time "T".

When the time "t" reaches a subsequent control time "T", the control unit 110 adds 1 to the number of control operations "n" in step S26, and the process goes to step S3 to perform a subsequent control operation.

When the control unit 110 confirms that the developing roller 21 is stopped in step S23, the control unit 110 completes the control procedures.

<Test for Confirming Effects>

Next, a description is given of tests for confirming the above-described effects.

In the tests, the inventors of the present invention confirmed the above-described effects with the color printer 100 that serves as an image forming apparatus for the test examples and a related-art image forming apparatus that incorporates the dual-axis type developing unit using a two-component developer for the comparative examples. Specifically, the inventors measured time variations of toner charge distributions when an image with 2,000 sheets of a 1% image area ratio and 20 sheets of a solid image (with a 100% image area ratio) are sequentially output, respectively. In the test examples, as described above, the toner charge distributions were measured with E-spart Analyzer manufactured by Hosokawa Micron Corporation.

Figure 21A:
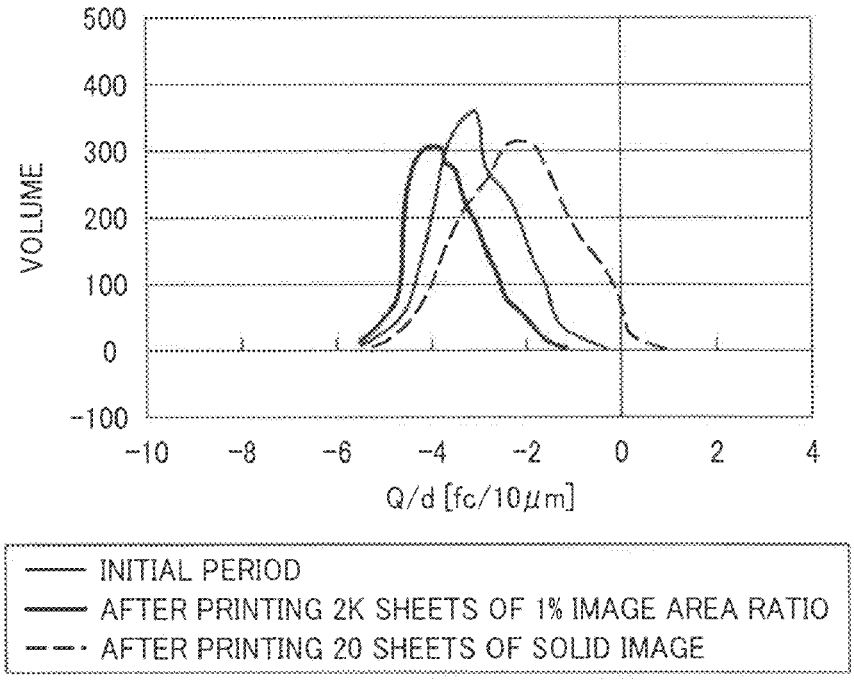
FIG. 21A is a graph showing a relation of toner agitation period and charged state of the comparative examples.
Figure 21B:
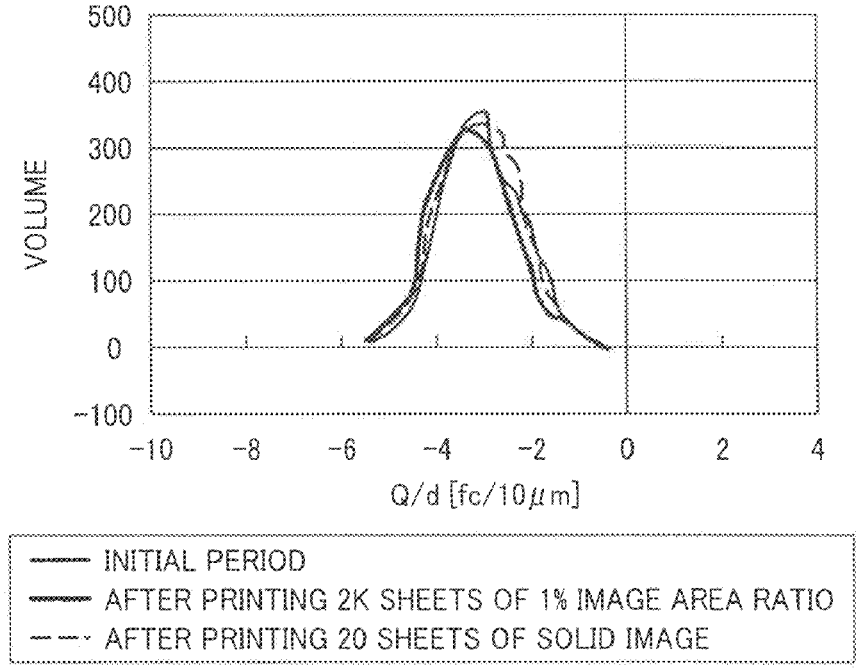
FIG. 21B is a graph showing a relation of toner agitation period and charged state of the test examples.

FIGS. 21A and 21B are graphs showing a relation of toner agitation period and charged state, which corresponds to time variations of toner charge distributions. The graph of FIG. 21A shows the results of the comparative examples, and the graph of FIG. 21B shows the results of the test examples.

As can be seen from the graph of FIG. 21A, by outputting the images, the toner charge distributions of the comparative examples shifted between the large charge amount and the small charge amount according to the agitation times. By contrast, the test examples shown in the graph of FIG. 21B maintained stable toner charge distributions if a certain amount of images with a high image area ratio (solid image, 100%) and of images with a low image area ratio (1%) were output, and therefore resulted in a reduction in toner deterioration such as charge-ups.

Next, a description is given of a preferably used toner for the developing unit 13Y according to the present invention and the color printer 100 according to the present invention.

It is preferable that a shape factor "SF-1" of the toner used in each of the developing units 13Y, 13M, 13C, and 13K is in a range of from approximately 100 to approximately 180, and the shape factor "SF-2" of the toner used in each of the developing units 13Y, 13M, 13C, and 13K is in a range of from approximately 100 to approximately 180.

Figure 22:
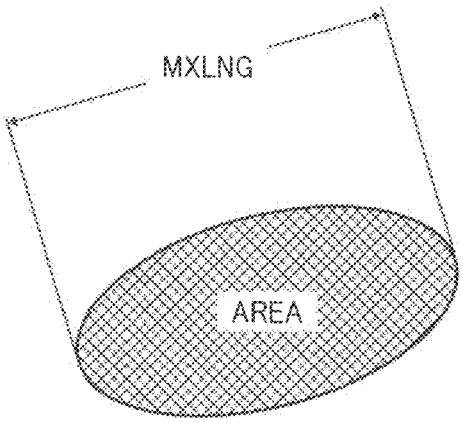
FIG. 22 is a drawing of a toner having an "SF-1" shape factor.

Referring to FIG. 22, the shape factor "SF-1" is a parameter representing the roundness of a particle. The shape factor "SF-1" of a particle is calculated by a following Equation 10:

$$SF\text{-}1=\{(MXLNG)^2/\text{AREA}\}\times(100\pi/4) \qquad \text{Equation 10,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 23:
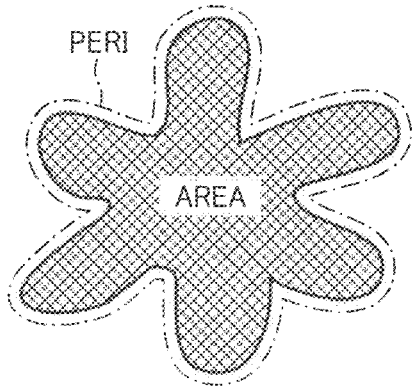
FIG. 23 is a drawing of a toner having an "SF-2" shape factor.

Referring to FIG. 23, the shape factor "SF-2" is a value representing irregularity (i.e., a ratio of convex and concave portions) of the shape of the toner. The shape factor "SF-2" of a particle is calculated by a following Equation 11:

$$SF\text{-}2=\{(\text{PERI})^2/\text{AREA}\}\times(100\pi/4) \qquad \text{Equation 11,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As the toner shape becomes spherical, a toner particle becomes held in point-contact with another toner particle or the photoconductor 1. Under the above-described condition, the toner adhesion force between two toner particles may decrease, resulting in the increase in toner fluidity, and the toner adhesion force between the toner particle and the photoconductor 1 may decrease, resulting in the increase in toner transferability. And, a toner container may easily collect reversely charged toner.

Further, considering collecting performance, it is preferable that the values of the shape factors "SF-1" and "SF-2" are 100 or greater. As the values of the shape factors "SF-1" and "SF-2" become greater, the toner charge distribution becomes greater and a load to the toner storing unit 40 becomes greater. Therefore, the values of the shape factors "SF-1" and "SF-2" are preferable to be less than 180.

The preferred toner for use in the developing unit and the image forming apparatus according to the present invention is produced through bridge reaction and/or elongation reaction of a liquid toner material in aqueous solvent. Here, the liquid toner material is generated by dispersing polyester prepolymer including an aromatic group having at least nitrogen atom, polyester, a coloring agent, and a release agent in organic solvent. In the following, toner constituents and a toner manufacturing method are described in detail.

(Polyester)

Polyester is produced by the condensation polymerization reaction of a polyhydric alcohol compound with a polyhydric carboxylic acid compound.

A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1.4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of the above-mentioned bisphenols (ethylene oxide, propylene oxide, butylene oxide or the like).

Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) may be divalent carboxylic acid (DIC) and tri- or more valent polycarboxylic acid (TC). Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges from 1.5/1 through 1/1. In particular, the ratio is preferably between 1.3/1 and 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from 150° C. to 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate (PIC) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as αααά-te-tramethylxylylenediisocyanate; isocyanurate; the above-mentioned polyisocyanate blocked with phenol derivatives, oxime and caprolactam; and their combinations.

The polyisocyanate (PIC) is mixed with a polyester such that the equivalent ratio ([NCO]/[OH]) between the isocyanate group [NCO] of the polyisocyanate (PIC) and the hydroxyl group [OH] of the polyester is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When the molar ratio of [NCO] is less than 1, the urea content in the resultant modified polyester decreases and hot offset resistance of the resultant toner deteriorates.

The content of the constitutional unit obtained from a polyisocyanate (PIC) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of amino acid (B5) are aminopropionic acid and caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention include a urea-modified polyesters (i). The urea-modified polyester (i) may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of 150° C. to 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from 40° C. to 140° C. to prepare a polyester prepolymer (A) having an isocyanate group. The prepolymer (A) is further reacted with an amine (B) at a temperature of from 0° C. to 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

A reaction anticatalyst can optionally be used in the crosslinking and/or elongation reaction between the polyester prepolymer (A) and amines (B) to control a molecular weight of the resultant urea-modified polyesters, if desired. Specific examples of the reaction anticatalyst include monoamines such as diethyl amine, dibutyl amine, butyl amine and lauryl amine, and blocked amines, i.e., ketimine compounds prepared by blocking the monoamines described above.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the full-color image forming apparatus, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 95/5 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45° C. to 65° C., and preferably from 45° C. to 60° C. When the glass transition temperature is less than 45° C., the high temperature preservability of the toner deteriorates. When the glass transition temperature is higher than 65° C., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1% by weight to 15% by weight, and more preferably from 3% by weight to 10% by weight, based on the total weight of the toner.

The colorants mentioned above for use in the present invention can be used as master batch pigments by being combined with a resin.

The examples of binder resins to be kneaded with the master batch or used in the preparation of the master batch are styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used alone or in combination.

(Charge Controlling Agent)

Specific examples of the charge controlling agent include known charge controlling agents such as Nigrosine dyes, triphenylmethane dyes, metal complex dyes including chromium, chelate compounds of molybdic acid, Rhodaminedyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative) PR, COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added, the toner manufacturing method (such as dispersion method) used, and is not particularly limited. However, the content of the charge controlling agent is typically from 0.1 parts by weight to 10 parts by weight, and preferably from 0.2 parts by weight to 5 parts by weight, per 100 parts by weight of the binder resin included in the toner. When the content is too high, the toner has an overlarge charge quantity. Consequently, the electrostatic force of a developing roller attracting the toner increases, resulting in deterioration of the fluidity of the toner and decrease of the image density of toner images.

(Releasing Agent)

A wax for use in the toner of the present invention as a releasing agent has a low melting point of from 50° C. to 120° C. When such a wax is included in the toner, the wax is dispersed in the binder resin and serves as a releasing agent at a location between a fixing roller and the toner particles. Thereby, hot offset resistance can be improved without applying an oil to the fixing roller used. Specific examples of the releasing agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

These charge controlling agents and releasing agents can be dissolved and dispersed after being kneaded and receiving an application of heat together with a master batch pigment and a binder resin; and can be added when directly dissolved and dispersed in an organic solvent.

(External Additives)

The inorganic particulate material preferably has a primary particle diameter of from $5\times10^{-3}$ to 2 μm, and more preferably from $5\times10^{-3}$ to 0.5 μm. In addition, a specific surface area of the inorganic particulates measured by a BET method is preferably from 20 $m^2/g$ to 500 $m^2/g$. The content of the external additive is preferably from 0.01% to 5% by weight, and more preferably from 0.01% to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, it is preferable to use hydrophobic silica fine grains and hydrophobic titanium oxide fine grains in combination. Particularly, when such two kinds of fine grains, having a mean grain size of $5\times10^{-2}$ μm or below, are mixed together, there can be noticeably improved an electrostatic force and van del Waals force with the toner. Therefore, despite agitation effected in the developing device for implementing the desired charge level, the fluidity imparting agent does not part from the toner grains and insures desirable image quality free from spots or similar image defects. In addition, the amount of residual toner can be reduced.

Titanium oxide fine grains are desirable for environmental stability and image density stability, but tend to have lower charge start characteristics. Therefore, if the amount of titanium oxide fine particles is larger than the amount of silica fine grains, then the influence of the above side effect increases. However, so long as the amount of hydrophobic silica fine grains and hydrophobic titanium oxide fine grains is between 0.3 wt. % and 1.5 wt. %, the charge start characteristics are not noticeably impaired, i.e., desired charge start characteristics are achievable. Consequently, stable image quality is achievable despite repeated copying operations.

The toner of the present invention is produced by the following method, but the manufacturing method is not limited thereto.

[Preparation of Toner]

(1) First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

(2) The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 parts by weight to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium, 3-lomega-fluoroalkanoyl(C6-C8)-N-ethylamino}-1-propanesulfonate, fluoroalkyl(C11-C20)carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10) sulfoneamidepropyltrimethylammonium salts, salts of perfluoroalkyl (C6-C10)-N-ethylsulfonylglycin, monoperfluoroalkyl(C6-C16)e- thylphosphates, etc.

Specific examples of the marketed products of such surfactants having a fluoroalkyl group include SARFRON® S-111, S-112 and S-113, which are manufactured by ASAHI GLASS CO., LTD.; FLUORAD® FC-93, FC-95, FC-98 and FC-129, which are manufactured by SUMITOMO 3M LTD.; UNIDYNE® DS-101 and DS-102, which are manufactured by DAIKIN INDUSTRIES, LTD.; MEGAFACE® F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT® F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON® S-121 (manufactured by ASAHI GLASS CO., LTD.); FLUORAD® FC-135 (manufactured by SUMITOMO 3M LTD.); UNIDYNE DS-202 (manufactured by DAIKIN INDUSTRIES, LTD.); MEGAFACE® F-150 and F-824 (manufactured by DAINIPPON INK AND CHEMICALS, INC.); ECTOP EF-132 (manufactured by TOHCHEM PRODUCTS CO., LTD.); FUTARGENT® F-300 (manufactured by NEOS); etc.

Resin fine particles are added to stabilize toner source particles formed in the aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 μm to 20 μm. The number of rotations of the high speed shearing type dispersers is not particularly limited, but is usually 1,000 rpm (revolutions per minute) to 30,000 rpm, and preferably 5,000 rpm to 20,000 rpm. While the dispersion time is not limited, it is usually 0.1 minute to 5 minutes for the batch system. The dispersion temperature is usually 0° C. to 150° C., and preferably 40° C. to 98° C. under a pressurized condition.

(3) At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minutes to 40 hours, and preferably from 2 hours to 24 hours. The reaction temperature is typically from 0° C. to 150° C., and preferably from 40° C. to 98° C. In addition, a known catalyst such as dibutyltinlaurate and dioctyltinlaurate can be used. The amines (B) are used as the elongation agent and/or crosslinker.

(4) After the above reaction, the organic solvent is removed from the emulsion (reaction product), and the resultant particles are washed and then dried. Thus, mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

(5) Then a charge controlling agent is penetrated into the mother toner particles, and inorganic fine particles such as silica, titanium oxide etc. are added externally thereto to obtain the toner of the present invention.

In accordance with a well-known method, for example, a method using a mixer, the charge controlling agent is provided, and the inorganic particles are added.

Thus, a toner having a small particle size and a sharp particle size distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition from a smooth surface to a rough surface such as the surface of pickled plum.

Further, the toner used in the color printer 100 serving as an image forming apparatus may be substantially spherical.

Figure 24A:
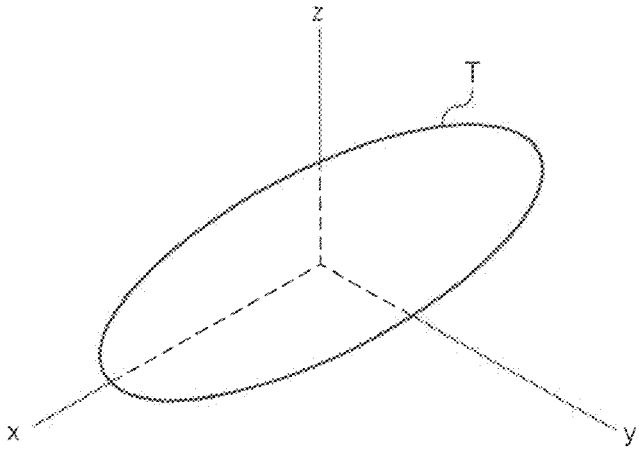
FIG. 24A is an outer shape of a toner used in the image forming apparatus of FIG. 2, and FIGS. 24B and 24C are schematic cross-sectional views of the toner, showing major and minor axes and a thickness of FIG. 7A.
Figure 24B:
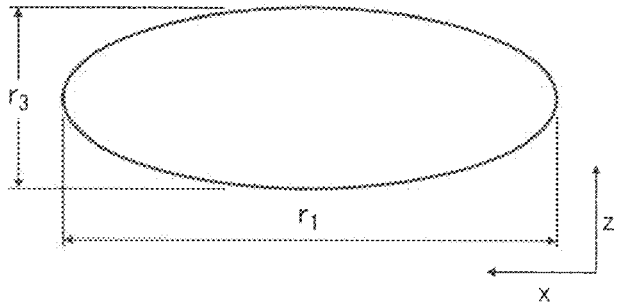
Figure 24C:
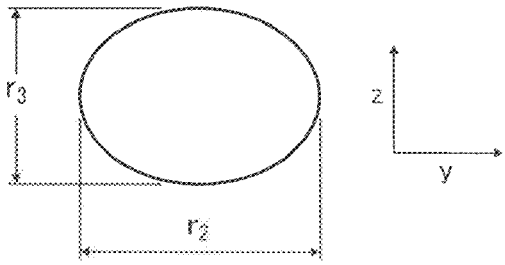

Referring to FIGS. 24A, 24B, and 24C, sized of the toner is described. An axis "x" of FIG. 24A represents a major axis "r1" of FIG. 24B, which is the longest axis of the toner. An axis "y" of FIG. 24A represents a minor axis "r2" of FIG. 24B, which is the second longest axis of the toner. The axis "z" of FIG. 24A represents a thickness "r3" of FIG. 24B, which is a thickness of the shortest axis of the toner. The toner has a relationship between the major and minor axes "r1" and "r2" and the thickness "r3" as follows:

$$r1 \geqq r2 \geqq r3.$$

The toner of FIG. 24A is preferably in a spindle shape in which the ratio (r2/r1) of the major axis "r1" to the minor axis "r2" is approximately 0.5 to approximately 1.0, and the ratio (r3/r2) of the thickness "r3" to the minor axis "r2" is approximately 0.7 to approximately 1.0.

When the ratio (r2/r1) is less than approximately 0.5, the toner has an irregular particle shape, and the value of the toner charge distribution increases.

When the ratio (r3/r2) is less than approximately 0.7, the toner has an irregular particle shape, and the value of the toner charge distribution increases.

When the ratio (r3/r2) is approximately 1.0, the toner has a substantially round shape, and the value of the toner charge distribution decreases.

The lengths showing with "r1", "r2" and "r3" can be monitored and measured with scanning electron microscope (SEM) by taking pictures from different angles.

As described above, the color printer 100 serving as an image forming apparatus according to the above-described exemplary embodiments includes a 4-drum tandem engine and indirect transfer system. However, the present invention can be applied, not limited to the above-described image forming apparatus but, to an image forming apparatus including a 4-drum tandem engine and direct transfer system or including one image forming unit for monochrome development.

Further, the developer bearing member, agitation and conveyance member, conveyance member in the descriptions regarding the developing unit according to the above-described exemplary embodiments of the present invention, and the optical writing unit, the image forming unit including the charging unit, the cleaning unit, etc., the transfer unit, the sheet feeding mechanism, the fixing unit, the sheet discharging part, etc. in the descriptions regarding the color printer 100 according to the above-described exemplary embodiments are examples. That is, configurations of known devices or units different from the above devices or units can be employed. In that case, it is obvious that the same effect to the above-described drawbacks can be achieved. Development is performed by which toner is transferred from the developing roller or developer bearing member to the photoconductor or image bearing member. The forms and configurations shown in the drawings are preferable examples, and all such variations in design comprise insubstantial changes over the descriptions conveyed by the illustrative embodiments. The invention is thus to be construed as including all possible modifications and variations encompassed within the scope of the claims of the issued patent.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A developing unit, comprising:

a developer case to accommodate a two-component developer including toner particles and carrier particles;

a developer bearing member disposed in the developer case and bearing the two-component developer to supply to an electrostatic latent image for development of the electrostatic latent image into a visible image;

a developer supply path formed inside the developer case to supply the two-component developer along an axial direction of the developer bearing member;

an agitation and conveyance member disposed in the developer supply path to agitate and convey the two-component developer;

a toner collecting mechanism to collect toner particles from the two-component developer remaining on the developer bearing member after development;

a collected toner conveyance path formed inside the developer case and separated from the developer supply path, comprising a collected toner conveying member disposed therewithin to convey toner collected by the toner collecting mechanism;

a developer releasing area where the developer is separated from the developer bearing member using a magnetic repulsion force, the collected toner conveyance path and the developer supply path arranged in communication with each other in the vicinity of one end of the collected toner conveyance path in a direction of conveyance of collected toner so as to recirculate toner unused for development, and wherein the toner collecting mechanism is located outside of the developer releasing area, and the developer releasing area is located between an image development area and the toner collection mechanism, and wherein an axis of a roller of the toner collection mechanism is higher than an axis of the developer bearing member.

2. The developing unit according to claim 1, wherein the sum of a total amount of toner particles in the toner collecting mechanism and the collected toner conveyance path and a total amount of toner particles electrostatically adhered to the carrier particles has a coverage of at least 100% with respect to a total amount of carrier particles.

3. The developing unit according to claim 1, wherein the toner collecting mechanism collects toner not during image development with toner moving from the developer bearing member.

4. The developing unit according to claim 1, wherein the toner collecting mechanism comprises:

a toner collection roller to electrostatically collect toner particles remaining on the developer bearing member; and a toner collection member to collect toner particles from a surface of the toner collection roller.

5. The developing unit according to claim 4, wherein, when a toner collection ratio is converted to an image area ratio of an image to a total surface area of a recording medium based on a weight of collected toner, the toner collection mechanism sets a bias voltage of the toner collection roller to an image area ratio of at least 5% for printing one given transfer medium as a reference.

6. The developing unit according to claim 1, further comprising a toner collection hopper provided in the vicinity of an end portion of the collected toner conveyance path in a direction of conveyance of toner to contain toner not supplied to the developer bearing member for image forming and toner collected by the toner collecting mechanism.

7. The developing unit according to claim 1, wherein the toner collecting mechanism collects toner from an entire image area in a longitudinal direction of the developer bearing member.

8. The developing unit according to claim 1, wherein the toner collecting mechanism collects only from a downstream side of the developer bearing member in a direction of conveyance of the developer.

9. The developing unit according to claim 1, further comprising:

a collected developer conveyance path including a developer conveyance member separated from the agitation and conveyance member to convey the developer collected from the developer releasing area, the collected developer conveyance path conveying developer in a same direction as a direction of conveyance of collected toner in the collected toner conveyance path, the collected developer conveyance path, the collected toner conveyance path, and the developer supply path being disposed in communication with each other in the vicinity of an end portion of the developing unit in a direction of conveyance of the collected toner and the collected developer so as to circulate toner and developer unused for development.

10. The developing unit according to claim 1, wherein the toner collecting mechanism is disposed downstream from the image development area and upstream from the developer releasing area, and disposed in proximity to the developer bearing member.

11. An image forming apparatus, comprising:

an image bearing member to bear an electrostatic latent image on a surface thereof; and the developing unit according to claim 1.

12. An image forming apparatus according to claim 11, further comprising:

a new toner container to contain new toner;

a new toner supply path in communication with the new toner container and the developing unit to supply the new toner to the developing unit;

a new toner conveyance member mounted on the new toner supply path to convey the new toner and control an amount of supply of the new toner;

a collected toner conveyance member disposed in the collected toner conveyance path to convey the collected toner and control an amount of supply of collected toner; and a control unit to control an amount of conveyance of toner by the new toner conveyance member, an amount of conveyance of toner by the collected toner conveyance member, and an amount of collected toner collected by the toner collecting mechanism, the control unit controlling an amount of collected toner per unit of time such that, when an amount of collected toner per unit of time where the toner is transferred from the developing unit to the image bearing member and consumed at a development area is smaller than a reference amount, the amount of collected toner per unit of time collected by the toner collecting mechanism is conveyed by the collected toner conveyance member and exceeds the amount of supply of collected toner to be supplied to the developer supply path, and when the amount of consumed toner per unit of time is greater than the reference amount, the amount of collected toner per unit of time is reduced to below the amount of supply of collected toner.

13. The image forming apparatus according to claim 12, wherein, when the amount of consumed toner per unit of time is equal to or smaller than the reference amount, the controlling unit makes the amount of collected toner per unit of time equal to or greater than a difference between the reference amount and the amount of consumed toner per unit of time.

14. The image forming apparatus according to claim 12, wherein, when the amount of consumed toner per unit of time is equal to or smaller than the reference amount, in a supply of toner to the developer supply path, new toner is supplied by using the new toner conveyance member instead of supplying the collected toner by using the collected toner conveyance member.

15. The image forming apparatus according to claim 12, wherein, when the amount of consumed toner per unit of time is greater than the reference amount, the toner collecting mechanism is not used for collecting toner.

16. The image forming apparatus according to claim 12, wherein, when the amount of consumed toner per unit of time is greater than the reference amount, in a supply of toner to the developer supply path, the collected toner only is supplied by using the collected toner conveyance member instead of supplying new toner by using the new toner conveyance member.

17. The image forming apparatus according to claim 12, wherein, when the amount of consumed toner per unit of time is greater than the reference amount, in a supply of toner to the developer supply path, the control unit supplies new toner by using the new toner conveyance member to determine the amount of supply of new toner per unit of time as the reference amount, and makes the amount of collected toner per unit of time equal to a difference between the amount of consumed toner per unit of time and the reference amount.

18. An image forming apparatus, comprising:

an image bearing member to bear an electrostatic latent image on a surface thereof; and a developing unit including:

a developer case to accommodate a two-component developer including toner particles and carrier particles;

a developer bearing member disposed in the developer case and bearing the two-component developer to supply to an electrostatic latent image for development of the electrostatic latent image into a visible image;

a developer supply path formed inside the developer case to supply the two-component developer along an axial direction of the developer bearing member;

an agitation and conveyance member disposed in the developer supply path to agitate and convey the two-component developer;

a toner collecting mechanism to collect toner particles from the two-component developer remaining on the developer bearing member after development;

a collected toner conveyance path formed inside the developer case and separated from the developer supply path, comprising a collected toner conveying member disposed therewithin to convey toner collected by the toner collecting mechanism;

a developer releasing area where the developer is separated from the developer bearing member using a magnetic repulsion force, the collected toner conveyance path and the developer supply path arranged in communication with each other in the vicinity of one end of the collected toner conveyance path in a direction of conveyance of collected toner so as to recirculate toner unused for development, and wherein the toner collecting mechanism is located outside of the developer releasing area, and the developer releasing area is located between an image development area and the toner collection mechanism, the image forming apparatus further including:

a new toner container to contain new toner;

a new toner supply path in communication with the new toner container and the developing unit to supply the new toner to the developing unit;

a new toner conveyance member mounted on the new toner supply path to convey the new toner and control an amount of supply of the new toner;

a collected toner conveyance member disposed in the collected toner conveyance path to convey the collected toner and control an amount of supply of collected toner; and a control unit to control an amount of conveyance of toner by the new toner conveyance member, an amount of conveyance of toner by the collected toner conveyance member, and an amount of collected toner collected by the toner collecting mechanism, the control unit controlling an amount of collected toner per unit of time such that, when an amount of collected toner per unit of time where the toner is transferred from the developing unit to the image bearing member and consumed at a development area is smaller than a reference amount, the amount of collected toner per unit of time collected by the toner collecting mechanism is conveyed by the collected toner conveyance member and exceeds the amount of supply of collected toner to be supplied to the developer supply path, and when the amount of consumed toner per unit of time is greater than the reference amount, the amount of collected toner per unit of time is reduced to below the amount of supply of collected toner, wherein a reference amount A corresponding to the reference amount is specified within a range satisfying an equation $$0.02 \cdot x \cdot T/t \leqq A \leqq 0.07 \cdot x \cdot T/t,$$

where "x" represents an amount of consumed toner when one solid image is output, "T" represents the unit time corresponding to a reference period of time in which the control unit controls at least one of toner collection and supply of collected toner, and "t" represents a time required for printing one image in continuous image printing.

19. The image forming apparatus according to claim 12, further comprising:

a toner-empty sensor to detect an empty state of collected toner in the collected toner conveyance path; and a toner-full sensor to detect a full state of collected toner in the collected toner conveyance path, such that (1) when the amount of consumed toner $a_n$ is equal to or smaller than a reference amount A corresponding to the reference amount and neither the toner-empty sensor nor the toner-full sensor detects either an empty state or a full state of the collected toner, respectively, the amount of collected toner $b_n$, the amount of supply of collected toner $c_n$, and the amount of supply of new toner $d_n$ are calculated according to Equation Set (1), $$b_n = A - a_n + \alpha,$$

$$c_n = \alpha, \text{ and}$$

$$d_n = A \qquad \text{Equation Set (1);}$$

(2) when the amount of consumed toner $a_n$ is greater than a reference amount A corresponding to the reference amount and neither the toner-empty sensor nor the toner-full sensor detects either an empty state or a full state of the collected toner, respectively, the amount of collected toner $b_n$, the amount of supply of collected toner $c_n$, and the amount of supply of new toner $d_n$ are calculated according to Equation Set (2), $$b_n = \beta,$$

$$c_n = a_n - \gamma + \beta, \text{ and}$$

$$d_n = \gamma \qquad \text{Equation Set (2);}$$

(3) when the amount of consumed toner $a_n$ is equal to or smaller than the reference amount A corresponding to the reference amount and the toner-empty sensor has detected an empty state of the collected toner, the amount of collected toner $b_n$, the amount of supply of collected toner $c_n$, and the amount of supply of new toner $d_n$ are calculated according to Equation Set (3), $$b_n = A - a_n + \alpha,$$

$$c_n = 0, \text{ and}$$

$$d_n = A + \alpha \qquad \text{Equation Set (3);}$$

(4) when the amount of consumed toner $a_n$ is greater than a reference amount A corresponding to the reference amount and the toner-empty sensor has detected an empty state of the collected toner, the amount of collected toner $b_n$, the amount of supply of collected toner $c_n$, and the amount of supply of new toner $d_n$ are calculated according to Equation Set (4), $$b_n = \beta,$$

$$c_n = 0, \text{ and}$$

$$d_n = a_n + \beta \qquad \text{Equation Set (4);}$$

(5) when the amount of consumed toner $a_n$ is equal to or smaller than the reference amount A corresponding to the reference amount and the toner-full sensor has detected a full state of the collected toner, the amount of collected toner $b_n$, the amount of supply of collected toner $c_n$, and the amount of supply of new toner $d_n$ are calculated according to Equation Set (5), $$b_n = A - a_n + \alpha,$$

$$c_n = A + \alpha, \text{ and}$$

$$d_n = 0 \qquad \text{Equation Set (5); and}$$

(6) when the amount of consumed toner $a_n$ is greater than a reference amount A corresponding to the reference amount and the toner-full sensor has detected a full state of the collected toner, the amount of collected toner $b_n$, the amount of supply of collected toner $c_n$, and the amount of supply of new toner $d_n$ are calculated according to Equation Set (6), $$b_n = \beta,$$

$$c_n = a_n + \beta, \text{ and}$$

$$d_n = 0 \qquad \text{Equation Set (6),}$$

where "α", "β", and "γ" represent respective arbitrary values, "α" represents any set value of 0 or above according to a volume of capacity of the collected toner conveyance path, "β" and "γ" represent any set value of 0 or above, and "A" represents a reference amount corresponding to an average amount of consumed toner, the control unit controlling to obtain the calculated amounts.

20. A method for controlling amounts of toner in an image forming apparatus including:

an image bearing member to bear an electrostatic latent image on a surface thereof; and a developing unit including:

a developer case to accommodate a two-component developer including toner particles and carrier particles;

a developer bearing member disposed in the developer case and bearing the two-component developer to supply to an electrostatic latent image for development of the electrostatic latent image into a visible image;

a developer supply path formed inside the developer case to supply the two-component developer along an axial direction of the developer bearing member;

an agitation and conveyance member disposed in the developer supply path to agitate and convey the two-component developer;

a toner collecting mechanism to collect toner particles from the two-component developer remaining on the developer bearing member after development;

a collected toner conveyance path formed inside the developer case and separated from the developer supply path, comprising a collected toner conveying member disposed therewithin to convey toner collected by the toner collecting mechanism;

a developer releasing area where the developer is separated from the developer bearing member using a magnetic repulsion force, the collected toner conveyance path and the developer supply path arranged in communication with each other in the vicinity of one end of the collected toner conveyance path in a direction of conveyance of collected toner so as to recirculate toner unused for development, and wherein the toner collecting mechanism is located outside of the developer releasing area, and the developer releasing area is located between an image development area and the toner collection mechanism, the image forming apparatus further including:

a new toner container to contain new toner;

a new toner supply path in communication with the new toner container and the developing unit to supply the new toner to the developing unit;

a new toner conveyance member mounted on the new toner supply path to convey the new toner and control an amount of supply of the new toner;

a collected toner conveyance member disposed in the collected toner conveyance path to convey the collected toner and control an amount of supply of collected toner; and a control unit to control an amount of conveyance of toner by the new toner conveyance member, an amount of conveyance of toner by the collected toner conveyance member, and an amount of collected toner collected by the toner collecting mechanism, the control unit controlling an amount of collected toner per unit of time such that, when an amount of collected toner per unit of time where the toner is transferred from the developing unit to the image bearing member and consumed at a development area is smaller than a reference amount, the amount of collected toner per unit of time collected by the toner collecting mechanism is conveyed by the collected toner conveyance member and exceeds than the amount of supply of collected toner to be supplied to the developer supply path, and when the amount of consumed toner per unit of time is greater than the reference amount, the amount of collected toner per unit of time is reduced to below the amount of supply of collected toner, the method comprising:

(1) calculating the amount of collected toner $b_n$, the amount of supply of collected toner $c_n$, and the amount of supply of new toner $d_n$ according to Equation Set (1), when the amount of consumed toner $a_n$ is equal to or smaller than a reference amount A corresponding the reference amount and a toner-empty sensor and a toner-full sensor detect neither an empty state nor a full state of the collected toner, $$b_n = A - a_n + \alpha,$$

$$c_n = \alpha, \text{ and}$$

$$d_n = A \qquad \text{Equation Set (1);}$$

(2) calculating the amount of collected toner $b_n$, the amount of supply of collected toner $c_n$, and the amount of supply of new toner $d_n$ according to Equation Set (2) when the amount of consumed toner $a_n$ is greater than a reference amount corresponding the reference amount and the toner-empty sensor and the toner-full sensor detect neither an empty state nor a full state of the collected toner, $$b_n = \beta,$$

$$c_n = a_n - \gamma + \beta, \text{ and}$$

$$d_n = \gamma \qquad \text{Equation Set (2);}$$

(3) calculating the amount of collected toner $b_n$, the amount of supply of collected toner $c_n$, and the amount of supply of new toner $d_n$ according to Equation Set (3) when the amount of consumed toner $a_n$ is equal to or smaller than the reference amount A corresponding to the reference amount and the toner-empty sensor has detected an empty state of the collected toner, $$b_n = A - a_n + \alpha,$$

$$c_n = 0, \text{ and}$$

$$d_n = A + \alpha \qquad \text{Equation Set (3);}$$

(4) calculating the amount of collected toner $b_n$, the amount of supply of collected toner $c_n$, and the amount of supply of new toner $d_n$ according to Equation Set (4) when the amount of consumed toner $a_n$ is greater than a reference amount A corresponding to the reference amount and the toner-empty sensor has detected an empty state of the collected toner, $$b_n = \beta,$$

$$c_n = 0, \text{ and}$$

$$d_n = a_n + \beta \qquad \text{Equation Set (4);}$$

(5) calculating the amount of collected toner $b_n$, the amount of supply of collected toner $c_n$, and the amount of supply of new toner $d_n$ according to Equation Set (5) when the amount of consumed toner $a_n$ is equal to or smaller than the reference amount and the toner-full sensor has detected a full state of the collected toner, $$b_n = A - a_n + \alpha,$$

$$c_n = A + \alpha, \text{ and}$$

$$d_n = 0 \qquad \text{Equation Set (5);}$$

(6) calculating the amount of collected toner $b_n$, the amount of supply of collected toner $c_n$, and the amount of supply of new toner $d_n$ according to Equation Set (6) when the amount of consumed toner $a_n$ is greater than a reference amount and the toner-full sensor has detected a full state of the collected toner, $$b_n = \beta,$$

$$c_n = a_n + \beta, \text{ and}$$

$$d_n = 0 \qquad \text{Equation Set (6),}$$

where "α", "β", and "γ" represent respective arbitrary values, "α" represents any set value of 0 or above according to a volume of capacity of the collected toner conveyance path, "β" and "γ" represent any set value of 0 or above, and "A" represents a reference amount corresponding to an average amount of consumed toner; and (7) controlling to obtain the calculated amounts.

* * * * *